US007862311B2

(12) United States Patent
Yamamuro et al.

(10) Patent No.: US 7,862,311 B2
(45) Date of Patent: Jan. 4, 2011

(54) VARIABLE DISPLACEMENT VANE PUMP

(75) Inventors: Shigeaki Yamamuro, Zushi (JP); Fusao Semba, Saitama (JP)

(73) Assignee: Hitachi, Ltd., Tokyo (JP)

( * ) Notice: Subject to any disclaimer, the term of this patent is extended or adjusted under 35 U.S.C. 154(b) by 433 days.

(21) Appl. No.: 12/042,457

(22) Filed: Mar. 5, 2008

(65) Prior Publication Data

US 2008/0219874 A1 Sep. 11, 2008

(30) Foreign Application Priority Data

Mar. 5, 2007 (JP) ..... 2007-053722

(51) Int. Cl.
*F03C 2/00* (2006.01)
*F04C 2/00* (2006.01)

(52) U.S. Cl. ..... 418/30; 418/16; 418/29; 418/149; 418/268

(58) Field of Classification Search ..... 418/16, 418/29, 30, 31, 259, 268, 149
See application file for complete search history.

(56) References Cited

U.S. PATENT DOCUMENTS 6,976,830 B2 * 12/2005 Uchino ..... 418/30
7,070,399 B2 7/2006 Konishi et al.
7,128,542 B2 * 10/2006 Suzuki et al. ..... 418/30
7,682,135 B2 * 3/2010 Ueki et al. ..... 418/30
2005/0019175 A1 * 1/2005 Uchino et al. ..... 417/410.3
2005/0047938 A1 * 3/2005 Konishi et al. ..... 417/410.3

FOREIGN PATENT DOCUMENTS

JP 2003-172272 6/2003

* cited by examiner

*Primary Examiner*—Thomas E Denion
*Assistant Examiner*—Mary A Davis
(74) *Attorney, Agent, or Firm*—Antonelli, Terry, Stout & Kraus, LLP.

(57) ABSTRACT

A variable displacement vane pump includes a pump body, a rotor, an annular cam ring, a rear body closing the pump body, a low pressure supply passage constantly connecting the inlet passage and the other of the first fluid pressure chamber and the second fluid pressure chamber, a low pressure introduction port formed in the other of the pressure plate and the rear body, and opened in the other of the first fluid pressure chamber and the second fluid pressure chamber, and a low pressure introduction passage formed in the other of the pressure plate and the rear body, the low pressure introduction passage connecting the low pressure introduction port and the inlet side vane back pressure grooves.

14 Claims, 18 Drawing Sheets

VARIABLE DISPLACEMENT VANE PUMP

BACKGROUND OF THE INVENTION

This invention relates to a variable displacement vane pump.

U.S. Pat. No. 7,070,399 (corresponding to Japanese Patent Application Publication No. 2003-172272) shows an oil pump arranged to vary an outlet amount by a swing motion of a cam ring, and thereby to improve energy conservation. Moreover, in this oil pump, a hydraulic pressure in a vane back pressure groove of an inlet region is decreased to decrease a driving resistance of the pump, and thereby to further improve the energy conservation.

SUMMARY OF THE INVENTION

However, in this oil pump, a passage is formed to extend around the cam ring and the adapter ring from an inlet side passage to opposite side of the cam ring so as to supply a hydraulic fluid to the vane back pressure groove. Accordingly, there is a problem that the hydraulic passage becomes lengthened, and that a sufficient hydraulic pressure is not supplied to the vane back pressure grooves.

It is an object of the present invention to provide a variable displacement vane pump arranged to decrease a driving resistance by decreasing a hydraulic passage resistance, and to supply a sufficient hydraulic pressure to vane back pressure chambers.

According to one aspect of the present invention, a variable displacement vane pump comprises: a pump body; a drive shaft supported by the pump body; a rotor which is disposed in the pump body, which is driven by the drive shaft, which is formed with a plurality of slots in a circumferential direction, and which is provided with a plurality of vanes each slidably received in one of the slots; an annular cam ring receiving therein the rotor rotatably, the cam ring being disposed in the pump body, and arranged to swing about a swing axis, and to define a plurality of pump chambers with the vanes between the rotor and the cam ring; a rear body closing the pump body; a pressure plate received in the pump body, the pressure plate including a through hole receiving the drive shaft, and being arranged to be urged to the rotor by receiving an outlet pressure in an axial direction; inlet ports formed in the rear body and the pressure plate, and opened in a region in which volumes of the pump chambers are increased; outlet ports formed in the rear body and the pressure plate, and opened in a region in which the volumes of the pump chambers are decreased; first and second fluid pressure chambers formed radially outside the cam ring, and arranged to control an eccentric quantity of the cam ring; a pressure control device arranged to control a pressure introduced to one of the first fluid pressure chamber and the second fluid pressure chamber; inlet side vane back pressure grooves formed at positions corresponding to an inlet region, in a sliding surface between the rotor and the pressure plate and in a sliding surface between the rotor and the rear body, and arranged to supply a hydraulic fluid to base end portions of the slots of the rotor; outlet side vane back pressure grooves formed at positions corresponding to an outlet region, in the sliding surface between the rotor and the pressure plate and in the sliding surface between the rotor and the rear body, arranged so that the outlet pressure is introduced, and arranged to supply the outlet pressure to the base end portions of the slots of the rotor; an inlet passage formed in one of the pressure plate and the rear body, and connected with a reservoir tank storing the hydraulic fluid; a low pressure supply passage constantly connecting the inlet passage and the other of the first fluid pressure chamber and the second fluid pressure chamber; a low pressure introduction port formed in the other of the pressure plate and the rear body, and opened in the other of the first fluid pressure chamber and the second fluid pressure chamber; and a low pressure introduction passage formed in the other of the pressure plate and the rear body, the low pressure introduction passage connecting the low pressure introduction port and the inlet side vane back pressure grooves.

According to another aspect of the invention, a variable displacement vane pump comprises: a pump body; a drive shaft supported by the pump body; a rotor which is disposed in the pump body, which is driven by the drive shaft, which is formed with a plurality of slots in a circumferential direction, and which is provided with a plurality of vanes each slidably received in one of the slots; an annular cam ring receiving therein the rotor rotatably, the cam ring being disposed in the pump body, and arranged to swing about a swing axis, and to define a plurality of pump chambers with the vanes between the rotor and the cam ring; a rear body closing the pump body; a pressure plate received in the pump body, the pressure plate including a through hole receiving the drive shaft, and being arranged to be urged to the rotor by receiving an outlet pressure in an axial direction; inlet ports formed in the rear body and the pressure plate, and opened in a region in which volumes of the pump chambers are increased; outlet ports formed in the rear body and the pressure plate, and opened in a region in which the volumes of the pump chambers are decreased; first and second fluid pressure chambers formed radially outside the cam ring, and arranged to control an eccentric quantity of the cam ring; a pressure control device arranged to control a pressure introduced to one of the first fluid pressure chamber and the second fluid pressure chamber; an inlet passage formed in one of the pump body and the rear body, and connected with a reservoir tank storing the hydraulic fluid; a low pressure supply passage constantly connecting the inlet passage and the other of the first fluid pressure chamber and the second fluid pressure chamber; a low pressure introduction port formed in the other of the pump body and the rear body, and opened in the other of the first fluid pressure chamber and the second fluid pressure chamber; and a low pressure introduction passage formed in the other of the pump body and the rear body, the low pressure introduction passage connecting the low pressure introduction port and the inlet ports.

According to still another aspect of the invention, a variable displacement vane pump comprises: a pump body including a receiving portion opened in one axial direction; a drive shaft supported by the pump body; a rotor which is disposed in the receiving portion of the pump body, which is driven by the drive shaft, which is formed with a plurality of slots in a circumferential direction, and which is provided with a plurality of vanes each slidably received in one of the slots; an annular cam ring receiving therein the rotor rotatably, the cam ring being disposed in the pump body, and arranged to swing about a swing axis, and to define a plurality of pump chambers with the vanes between the rotor and the cam ring; a rear body closing the receiving portion of the pump body; a pressure plate received in the pump body, and arranged to be urged to the rotor by receiving an outlet pressure in the one axial direction; inlet ports formed in the rear body and the pressure plate, and opened in a region in which volumes of the pump chambers are increased; outlet ports formed in the rear body and the pressure plate, and opened in a region in which the volumes of the pump chambers are decreased; first and second fluid pressure chambers formed radially outside the cam ring, and arranged to control an eccentric quantity of the cam ring; a pressure control device arranged to control a pressure introduced to one of the first fluid pressure chamber and the second fluid pressure chamber; vane back pressure grooves formed in a sliding surface between the rotor and the pressure plate and in a sliding surface between the rotor and the rear body, and arranged to supply a hydraulic fluid to base end portions of the slots of the rotor; an inlet passage formed in the rear body, and connected with a reservoir tank storing the hydraulic fluid; a low pressure supply passage constantly connecting the inlet passage and the other of the first fluid pressure chamber and the second fluid pressure chamber; a low pressure introduction port formed in the pressure plate, and opened in the other of the first fluid pressure chamber and the second fluid pressure chamber; and a low pressure introduction passage formed in the pressure plate, the low pressure introduction passage connecting the low pressure introduction port with one of the inlet ports and the vane back pressure grooves on the inlet port's side.

According to still another aspect of the invention, a variable displacement vane pump comprises: a pump body including a receiving portion opened in one axial direction; a drive shaft supported by the pump body; a rotor which is disposed in the receiving portion of the pump body, which is driven by the drive shaft, which is formed with a plurality of slots in a circumferential direction, and which is provided with a plurality of vanes each slidably received in one of the slots; an annular cam ring receiving therein the rotor rotatably, the cam ring being disposed in the pump body, and arranged to swing about a swing axis, and to define a plurality of pump chambers with the vanes between the rotor and the cam ring; a rear body closing the receiving portion of the pump body; a pressure plate received in the pump body, and arranged to be urged to the rotor by receiving an outlet pressure in the one axial direction; inlet ports formed in the rear body and the pressure plate, and opened in a region in which volumes of the pump chambers are increased; outlet ports formed in the rear body and the pressure plate, and opened in a region in which the volumes of the pump chambers are decreased; first and second fluid pressure chambers formed radially outside the cam ring, and arranged to control an eccentric quantity of the cam ring; a pressure control device arranged to control a pressure introduced to one of the first fluid pressure chamber and the second fluid pressure chamber; vane back pressure grooves formed in a sliding surface between the rotor and the pressure plate and in a sliding surface between the rotor and the rear body, and arranged to supply a hydraulic fluid to base end portions of the slots of the rotor; an inlet passage formed in one of the pressure plate and the rear body, and connected with a reservoir tank storing the hydraulic fluid; a first low pressure supply passage connecting the inlet passage and the inlet ports; a second low pressure supply passage constantly connecting the inlet ports and the other of the first fluid pressure chamber and the second fluid pressure chamber; a low pressure introduction port formed in the other of the pressure plate and the rear body, and opened in the other of the first fluid pressure chamber and the second fluid pressure chamber; and a low pressure introduction passage formed in the other of the pressure plate and the rear body, the low pressure introduction passage connecting the low pressure introduction port with one of the inlet ports and the vane back pressure grooves on the inlet port's side.

DETAILED DESCRIPTION OF THE INVENTION

First Embodiment

FIGS. 1~5 show a variable displacement vane pump according to a first embodiment of the present invention.

[Outline of Variable Displacement Vane Pump]

Figure 1:
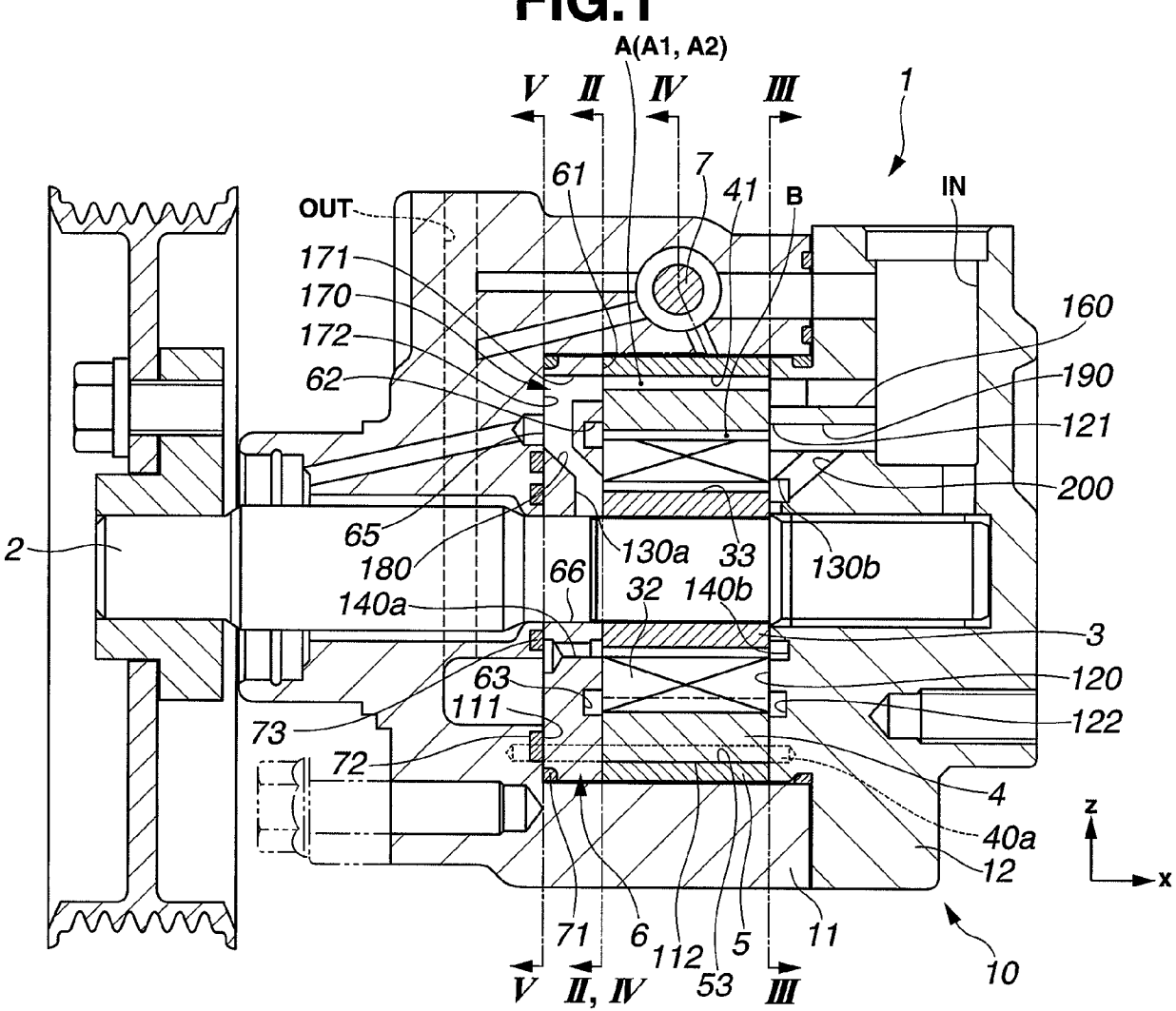
FIG. 1 is an axial sectional view (a sectional view taken along a section line I-I of FIG. 2) showing a vane pump according to a first embodiment of the present invention.
Figure 2:
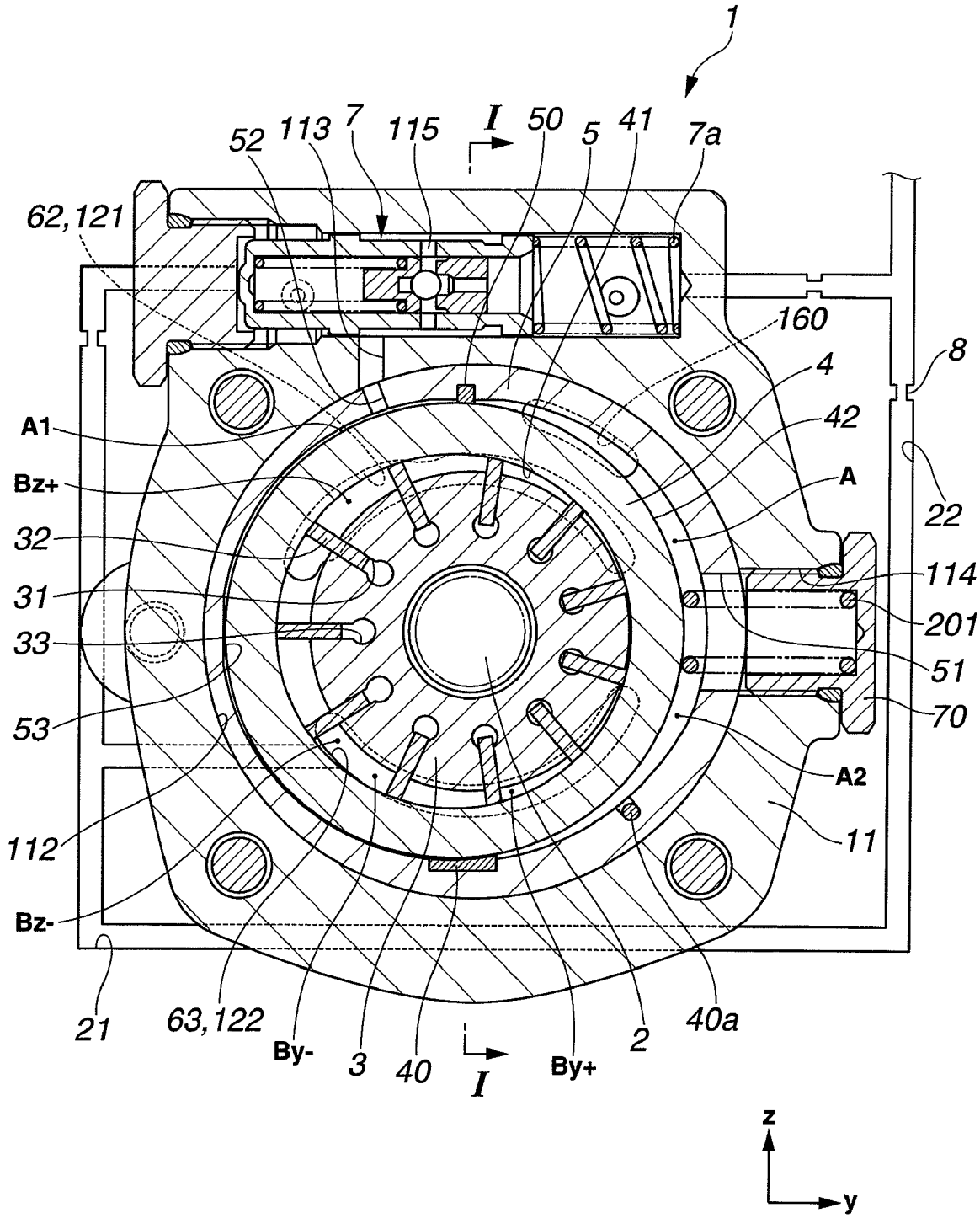
FIG. 2 is a radial sectional view (a sectional view taken along a section line IV-IV of FIG. 1) showing the vane pump of FIG. 1 in a maximum eccentric state.

FIG. 1 shows an axial sectional view (sectional view taken along a section line I-I of FIG. 2) showing a vane pump 1. FIG. 2 is a radial sectional view (sectional view taken along a section line IV-IV of FIG. 1). FIG. 2 shows a case in which a cam ring 4 is swung, to the maximum extent, to the y-axis negative side (maximum eccentric quantity).

Hereinafter, an x-axis is defined by an axial direction of a drive shaft 2. A positive direction of the x-axis is defined by a direction in which drive shaft 2 is inserted into a pump body 11 and a rear body 12. Moreover, a y-axis is defined by an axial direction of a spring 201 (as shown in FIG. 2) arranged to regulate a swing motion of cam ring 4. A negative direction of the y-axis is defined by a direction in which spring 201 urges cam ring 4. A z-axis is defined by an axis perpendicular to the x-axis and the y-axis. A positive direction of the z-axis is defined by a direction toward an inlet passage IN.

Vane pump 1 includes drive shaft 2, a rotor 3, a cam ring 4, an adapter ring 5, and a housing 10. Drive shaft 2 is connected through a pulley with an engine, and rotates as a unit with rotor 3.

Rotor 3 includes a plurality of slots 31 which are formed radially in an outer circumference portion of rotor 3, and which are grooves extending in the axial direction. A is vane 32 is inserted radially each of slots 31 so that vane 32 moves into and out of the slot 31. Each of slots 31 includes a back pressure chamber 33 located at an inner radial end portion of the slot 31, and arranged to urge the corresponding vane 32 in the radial outward direction when an oil pressure is supplied to the back pressure chamber 33 (cf., FIG. 2).

Housing 10 includes a pump body 11 and a rear body 12. Pump body 11 is shaped like a cup having a bottom (111), and opening toward the x-axis positive side (rightwards in FIG. 1, toward rear body 12). A pressure plate 6 in the form of a circular disk is disposed on a bottom portion 111 of pump body 11. Pump body 11 includes an inner circumferential wall which surrounds, and thereby defines a pump element receiving portion 112. Pump element receiving portion 112 contains adapter ring 5, cam ring 4 and rotor 3 on the x-axis positive side of pressure plate 6.

Rear body 12 is liquid-tightly abutted, from the x-axis positive side (from the right side as viewed in FIG. 1), on adapter ring 5, cam ring 4 and rotor 3. Adapter ring 5, cam ring 4 and rotor 3 are axially sandwiched by pressure plate 6 and rear body 12.

Pressure plate 6 includes a through hole 66 receiving drive shaft 2. Moreover, inlet ports 62 and 121 and outlet ports 63 and 122 are provided, respectively, in an x-axis positive side surface 61 of pressure plate 6, and in an x-axis negative side surface 120 of rear body 12, as shown in FIG. 1. Inlet ports 62 and 121 are connected with an inlet passage IN. Outlet ports 63 and 122 are connected with an outlet port OUT. Inlet and outlet ports 61, 121, 62 and 122 function to supply and drain the hydraulic fluid to a pump chamber B formed between rotor 3 and cam ring 4.

These inlet ports 62 and 121 are opened in a region (inlet region Bz+) in which volumes of a plurality of pump chambers B are increased. Outlet ports 63 and 122 are opened in a region (outlet region Bz−) in which volumes of the plurality of pump chambers are decreased.

Adapter ring 5 is a substantially elliptical annular member having a major axis along the y-axis, and a minor axis along the z-axis. Adapter ring 5 is surrounded by the inner circumference wall of pump body 11. Adapter ring 5 surrounds cam ring 4 on the radial inner side. Rotation of adapter ring 5 with respect to pump body 11 is restricted by a pin 40*a* so as not to rotate within pump body 11 at a pump driving operation.

Cam ring 4 is an annular member shaped like a circle and the outside diameter is substantially identical to the minor axis of adapter ring 5. Cam ring 4 is received inside the substantially elliptical adapter ring 5, and accordingly a fluid pressure chamber A is formed between the inner circumference of adapter ring 5 and the outer circumference of cam ring 4. Cam ring 4 can be swung in the y-axis direction within adapter ring 5.

A seal member 50 is provided in a z-axis positive direction end portion (upper end portion as viewed in FIG. 2) of an inner circumference surface 53 of adapter ring 5, and a support surface is formed in a z-axis negative direction end (or lower end) portion of inner circumference surface 53 of adapter ring 5. Adapter ring 5 supports, at the support surface, the z-axis negative direction portion of cam ring 4.

In the support surface, there is provided with a support plate 40. By support plate 40 and seal member 50, the fluid pressure chamber between cam ring 4 and adapter ring 5 is divided into a first fluid pressure chamber A1 on the y-axis negative side (the left side as viewed in FIG. 2) and a second fluid pressure chamber A2 on the y-axis positive side (the right side as viewed in FIG. 2) closer to spring 201.

An outside diameter of rotor 3 is smaller than an inner circumference 41 of cam ring 4. Rotor 3 having the smaller outside diameter is thus received in cam ring 4 having the larger inside diameter. The rotor 3 is designed so that the outer circumference of rotor 3 does not abut on the inner circumferential surface 41 of cam ring 4 even if cam ring 4 swings and the rotor 3 and cam ring 4 move relative to each other.

Moreover, in a case in which cam ring 4 is swung to the maximum extent, to the y-axis negative side, a distance between inner circumference 41 of cam ring 4 and the outer circumference of rotor 3 is largest on the y-axis negative side. In a case in which cam ring 4 is swung to the maximum extent, to the y-axis positive side, a distance L is smallest on the y-axis positive side.

A radial length of each vane 32 is larger than a maximum value of distance L (between the inside circumference surface 41 of cam ring 4 and the outside is circumferential surface of rotor 3). Accordingly, irrespective of changes in the relative position between cam ring 4 and rotor 3, each vane 32 remains in the state in which a radial inner portion of the vane 32 is received in the corresponding slot 31 of rotor 3, and a radial outer portion of the vane 32 abuts on the inside circumferential surface 41 of cam ring 4. Each vane 32 always receives the back pressure in the corresponding back pressure chamber 33, and abuts on the inside circumference surface 41 of cam ring 4 liquid-tightly.

Therefore, in the annular space between cam ring 4 and rotor 3, adjacent two of vanes 32 define a pumping chamber B always sealed liquid-tightly. In a case in which rotor 3 and cam ring 4 are in the eccentric state by the swing motion, the volumes of pump chambers B are varied in accordance with the rotation of rotor 3.

Inlet ports 62 and 121 and outlet ports 63 and 122 are provided along the outer circumference of rotor 3 in pressure plate 6 and rear body 12, and supply and discharge the hydraulic fluid by the variation of volume of each pump chamber B.

A radial through hole 51 is provided in the y-axis positive direction end portion of adapter ring 5. Moreover, a plug member insertion hole 114 is provided in the y-axis positive direction end portion of pump body 11. A plug member 70 shaped like a cup having a bottom is inserted in plug member insertion hole 114 of pump body 11, and arranged to seal the inside of vane pump 1 liquid-tightly with pump body 11 and rear body 12. the liquid-tight of first and rear bodies 11 and 12.

Spring 201 is received in plug member 70 so that spring 201 extend and compress in the y-axis direction. Spring 201 extends through radial through hole 51 of adapter ring 5, and abuts on cam ring 4. Spring 201 urges cam ring 4 in the negative direction of the y-axis.

This spring 201 urges cam ring 4 in the y-axis negative direction toward the swing position at which the cam ring 4 is swung to the greatest extent to the negative side of the y-axis and the eccentricity is maximum, and thereby stabilizes the discharge quantity (the swing position of cam ring 4) in a pump starting operation in which the pressure is unstable.

[Supplies of Hydraulic Fluid to First and Second Fluid Pressure Chambers]

A through hole 52 is formed in a z-axis positive side portion (or upper portion) of adapter ring 5 at a position on the y-axis negative side of seal member 50 (on the left side of seal member 50 as viewed in FIG. 2). This through hole 52 is connected with a control valve 7 through a hydraulic passage 113 formed in pump body 11. This through hole 52 connects control valve 7 and first fluid pressure chamber A1 on the y-axis negative direction side (on the left side in FIG. 2). Hydraulic passage 113 opens to a valve receiving hole 115 receiving control valve 7. In a pump driving operation, a control pressure is introduced into first fluid pressure chamber A1.

Through hole 52 is formed in adapter ring 5 in a center portion of width in the axial direction of adapter ring 5. Accordingly, the outer circumference surface of adapter ring 5 serves as the seal surface to decrease the leak.

Control valve 7 is connected through hydraulic passages 21 and 22 with outlet ports 63 and 122. An orifice 8 is provided in hydraulic passage 22. Control valve 7 receives an outlet pressure which is an upstream pressure of orifice 8, and a downstream pressure of orifice 8. This pressure difference and valve spring 7*a* drive control valve 7 to generate the control pressure.

Accordingly, the control pressure is introduced to first fluid pressure chamber A1. This control pressure is produced on the basis of the inlet pressure and the outlet pressure. Therefore, the control pressure is equal to or greater than the inlet pressure (control pressure≧inlet pressure).

On the other hand, the inlet pressure is introduced through a connection passage 160 to second fluid pressure chamber A2. This connection passage 160 connects inlet passage IN and x-axis negative side surface 120 in pump body 11 as shown in FIG. 1, and thereby connects inlet passage IN and second fluid pressure chamber A2 as shown in FIG. 2. Connection passage 160 is always opened in z-axis positive side region A2*z*+ of second fluid pressure chamber A2, irrespective of the swing position of cam ring 4. Accordingly, z-axis positive side region A2*z*+ has the inlet pressure.

Therefore, the inlet pressure is always introduced to second fluid pressure chamber A2. Consequently, in the vane pump according to the present invention, the only fluid pressure P1 of first fluid pressure chamber A1 is controlled. On the other hand, fluid pressure P2 of second fluid pressure chamber A2 is not controlled. Fluid pressure P2 is always the inlet pressure (P2=the inlet pressure). Consequently, it is possible to always stabilize the pressure of second fluid pressure chamber A2. Moreover, it is possible to prevent the disturbance of the hydraulic pressure, and to stabilize the swing control of cam ring 4.

[Swing Motion of Cam Ring]

When the urging force in the positive direction of the y-axis which is applied to cam ring 4 by pressure P1 of first fluid pressure chamber A1 becomes larger than the sum of the urging forces in the negative direction of the y-axis which is applied to cam ring 4 by hydraulic pressure P2 of second fluid pressure chamber A2 and spring 201, cam ring 4 is swung about support plate 40 in the positive direction of the y-axis. By the swing motion, the volume of pump chamber By+ on the positive side of the y-axis is increased, and the volume of pump chamber By− on the negative side of the y-axis is decreased.

In a case in which the volume of pump chamber By− on the negative side of the y-axis is decreased, the hydraulic fluid quantity per unit of time which is supplied from inlet ports 62 and 121 to outlet ports 63 and 122 is decreased. Consequently, the pressure difference between the upstream pressure and the downstream pressures of orifice 8 is decreased. Accordingly, control valve 7 is pushed back by valve spring 7*a* to decrease the control pressure of control valve 7. Therefore, pressure P1 of first fluid pressure chamber A1 is decreased, cam ring 4 is swung in the negative direction of the y-axis when cam ring 4 does not resist the sum of the urging force in the negative direction of the y-axis.

When the urging forces in the positive and negative directions of the y-axis becomes substantially identical to each other, the forces applied to cam ring 4 in the y-axis direction are balanced, so that cam ring 4 is rested. Consequently, the pressure difference of orifice 8 is increased by the increase of the quantity of the hydraulic fluid. Control valve 7 pushes valve spring 7*a*, and the valve control pressure is increased. Therefore, cam ring 4 is swung in the positive direction of the y-axis, contrary to the above-mentioned case. The quantity of the eccentric of cam ring 4 is determined so as to uniform the flow rate determined by the orifice radius of orifice 8 and spring 7*a*, without causing the swing hunting of cam ring 4.

[Introduction of Inlet Pressure (Low Pressure) to Vane Back Pressure Chamber]

Figure 3:
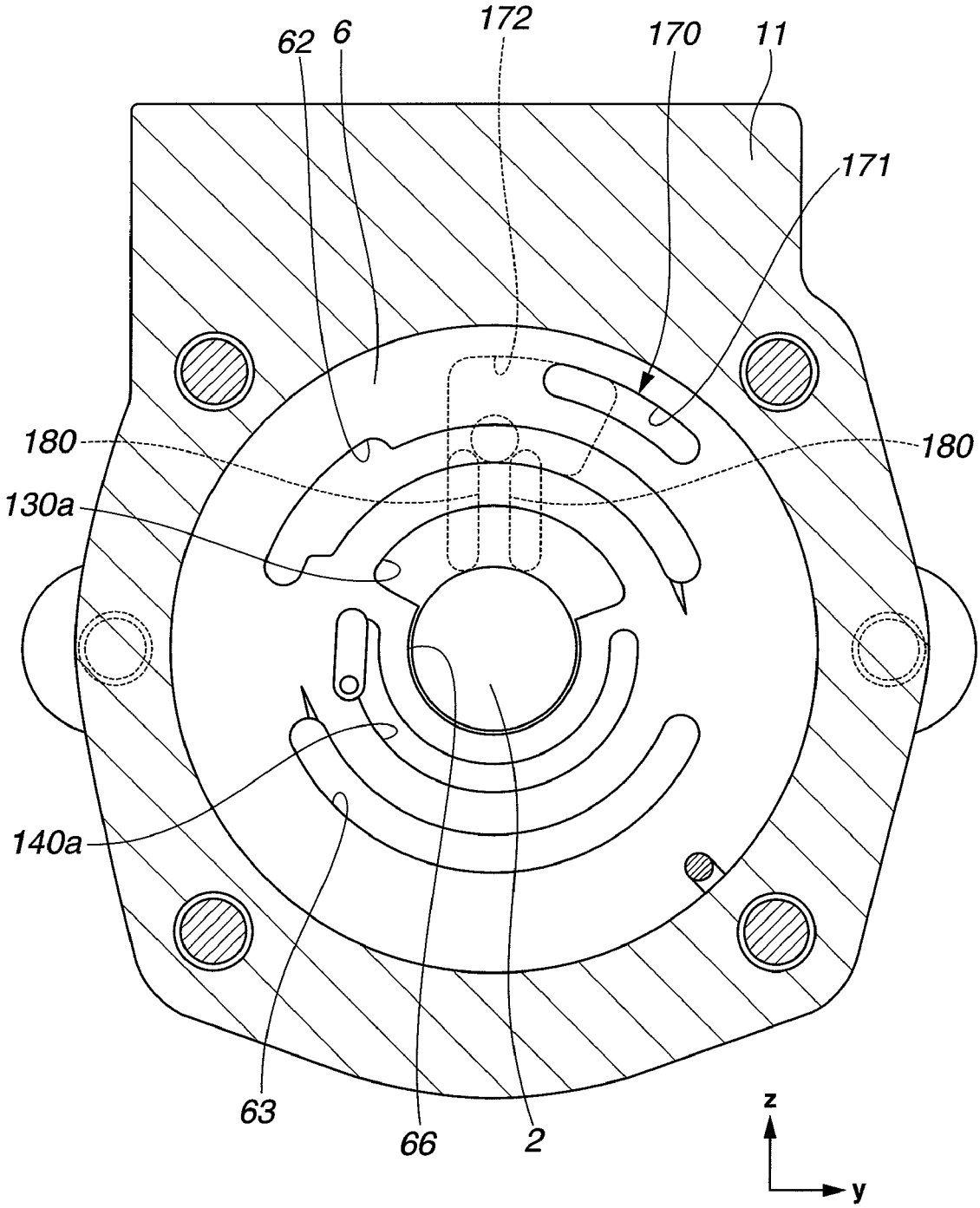
FIG. 3 is a sectional view taken along a section line II-II of FIG. 1.
Figure 4:
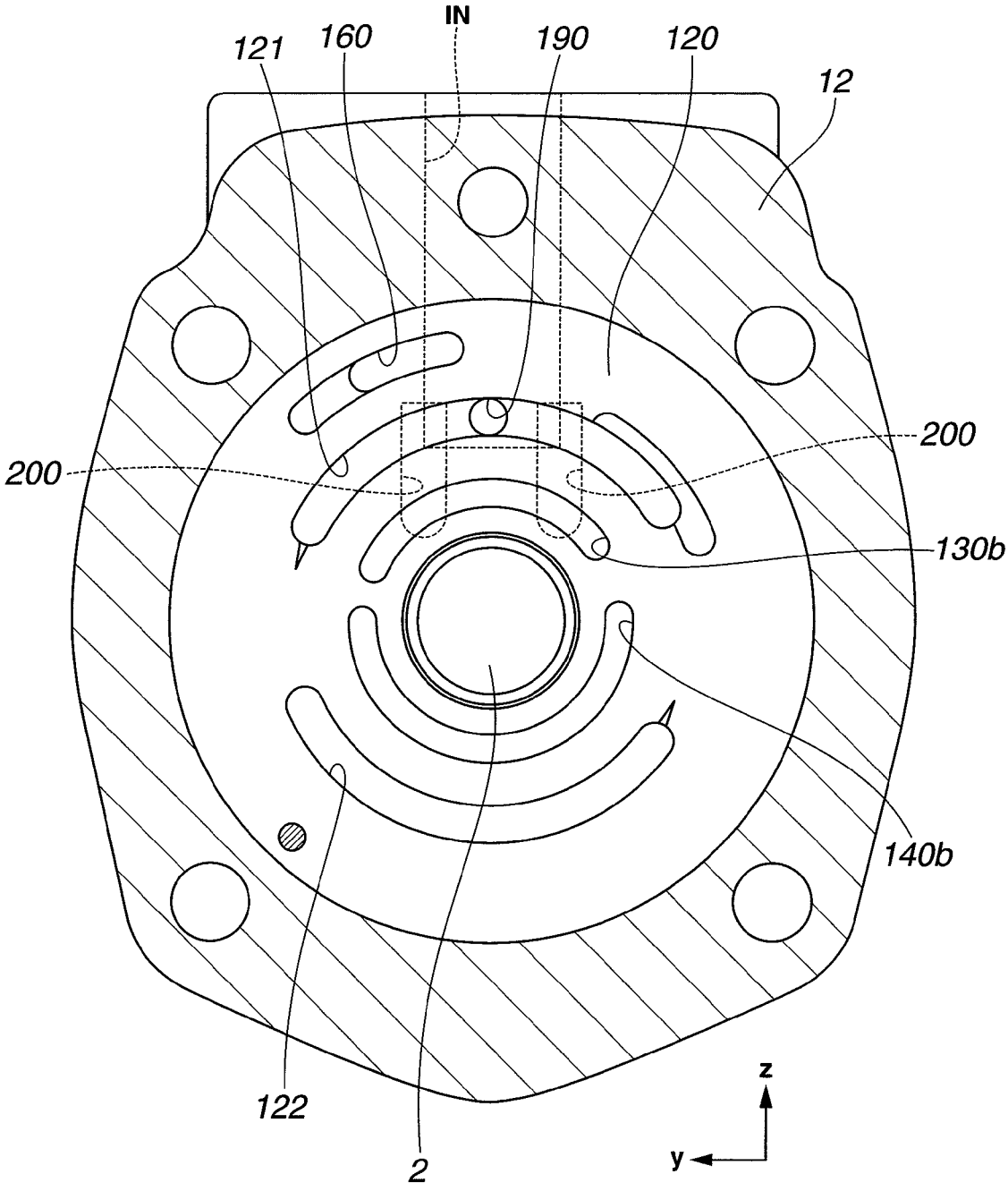
FIG. 4 is a sectional view taken along a section line III-III of FIG. 1.
Figure 5:
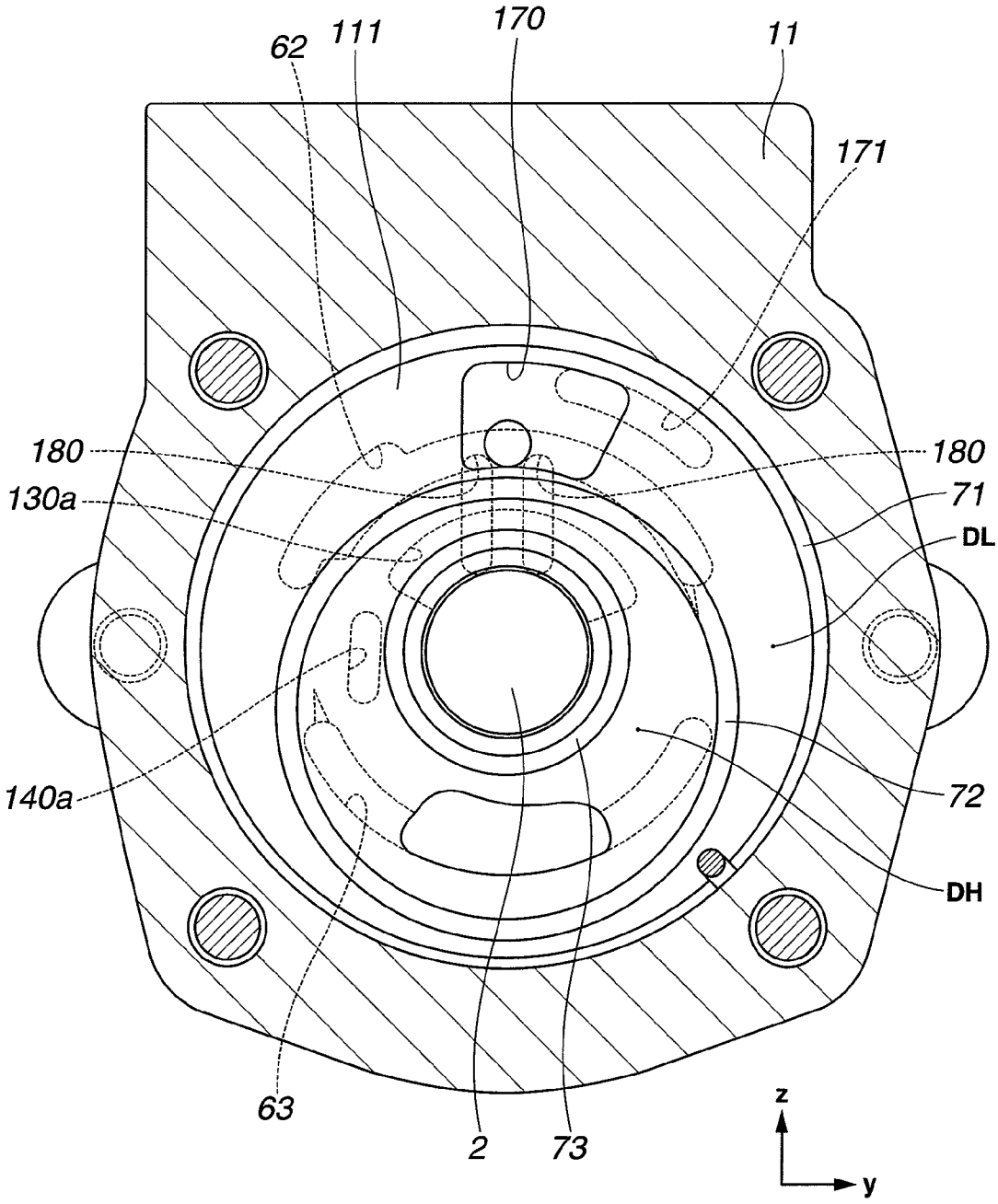
FIG. 5 is a sectional view taken along a section line V-V of FIG. 1.

FIG. 3 is a sectional view taken along a section line II-II of FIG. 1. FIG. 4 is a sectional view taken along a section line III-III of FIG. 1. FIG. 5 is a sectional view taken along a section line V-V of FIG. 1. Rear body 12 includes a first low pressure supply passage 160, a second low pressure supply passage 190, and first low pressure introduction passage 200.

(Supply of Inlet Pressure from Rear Body's Side)

First low pressure supply passage 160 connects inlet passage IN and second fluid pressure chamber A2 (cf. FIG. 2 and FIG. 4). Second low pressure supply passage 190 connects inlet passage IN and rear body inlet port 121.

Moreover, rear body 12 includes first low pressure introduction passage 200 which extends from second low pressure supply passage 190, and which connects inlet passage IN and first inlet side vane back pressure groove 130*b*. This first inlet side vane back pressure groove 130*b* is connected from rear body 12 to back pressure chamber 33 of each vane 32, and supplies the inlet pressure to back pressure chamber 33.

(Supply of Inlet Pressure from Pressure Plate's Side)

A low pressure introduction port 170 and a second low pressure introduction passage 180 are provided in an x-axis positive side surface 61 of pressure plate 6. Low pressure introduction port 170 and second low pressure introduction passage 180 are connected with each other. Low pressure introduction port 170 is connected through second fluid pressure chamber A2 to first low pressure supply passage 160, and the inlet pressure is introduced to low pressure introduction port 170 and second low pressure introduction passage 180.

This low pressure introduction port 170 includes a connecting portion 171 directly connected with second fluid pressure chamber A2; and an extension portion 172 extending radially inwards. Low pressure introduction port 170 is connected with second low pressure introduction passage 180 at extension portion 172.

Connecting portion 171 passes through pressure plate 6 in the x-axis direction. Extension portion 172 is provided in the x-axis negative side surface 65 of pressure plate 6. Moreover, second low pressure introduction passage 180 passes through pressure plate 6 in the x-axis direction. Accordingly, low pressure introduction port 170 and second low pressure introduction passage 180 are not connected with inlet port 62 of pressure plate 6.

Moreover, second low pressure introduction passage 180 is connected with back pressure chamber 33 of each vane 32 in x-axis positive direction surface 61 of pressure plate 6.

Accordingly, the inlet pressure is supplied to back pressure chamber 33 through first low pressure supply passage 160, low pressure introduction port 170, and second low pressure introduction passage 180.

Consequently, the inlet pressure is supplied to back pressure chambers 33 from rear body 12's side and pressure plate 6's side. The inlet pressure is readily supplied to back pressure chambers 33, and accordingly it is possible to ensure the protruding ability of the vane from each slot 31. Moreover, low pressure introduction port 170 is opened to second fluid pressure chamber A2, and the resistance of the fluid passage is decreased.

As mentioned above, control valve 7 controls the pressure introduced to first fluid pressure chamber A1, and first low pressure supply passage 160 constantly connects inlet passage IN and second fluid pressure chamber A2. Consequently, the outlet pressure discharged from pump outlet side By+ through cam ring 4 to second fluid pressure chamber A2 is supplied through low pressure introduction inlet 170 and low pressure introduction passage 180 to vane back pressure grooves 130*a* and 130*b*. Accordingly, the efficiency of the supply of the pressure to vane back pressure grooves 130*a* and 130*b* on the inlet side is improved.

Moreover, low pressure introduction port 170 is formed so that an opening area of low pressure introduction port 170 decreases as the eccentric quantity of cam ring 4 decreases. That is, extension portion 172 extends largely in the positive direction of the y-axis to increase the opening area, and however extension portion 172 does not extend in the negative direction of the y-axis.

Accordingly, when the outlet quantity is increased at the maximum eccentric state of cam ring 4 (the eccentric in the positive direction of the y-axis, as shown in FIG. 2), the opening area of low pressure introduction port 170 is increased. When the outlet quantity is decreased at the minimum eccentric state of cam ring 4 (zero of the eccentric quantity in the y-axis direction), the opening area of low pressure introduction port 170 is decreased. Therefore, low pressure introduction port 170 has the opening area according to the outlet quantity.

Moreover, first to third sealing members 71-73 are provided between pressure plate 6 and pump body 11, as shown in FIG. 5. First sealing member 71 seals a most outer circumference portion of pressure plate 6. Second sealing member 72 seals a portion which is radially inside inlet port 62, and which is radially outside outlet port 63. Third sealing member 73 seals a most inner circumference portion of pressure plate 6.

Therefore, first and second sealing members 71 and 72 seal between inlet port 62 and outlet port 63 in x-axis negative side surface 65.

Accordingly, a region between pressure plate 6 and pump body 11 is divided to a low pressure region DL (region sealed by first sealing member 71 and second sealing member 72), and a high pressure region DH (region sealed by second sealing member 72 and third sealing member 73). Consequently, low pressure introduction port 170 is formed in low pressure region DL. Therefore, pressure plate 6 is urged to cam ring 4 in high pressure region DH, and the low pressure is introduced in low pressure region.

Moreover, low pressure region DL is formed in a circumferential position corresponding to inlet port 62 (low pressure region DL is formed to include a position of inlet port 62). Pressure plate 6 is sandwiched by inlet port 62 and low pressure region DL, and accordingly portions on the both sides of pressure plate 6 in the x-axis direction become the low pressure. Therefore, the pressure balance of pressure plate 6 is improved.

Moreover, the pressure introduction passage is formed in pressure plate 6, and connected to inlet side vane back pressure grooves 130*a* and 130*b*. At least part of the pressure introduction passages is formed by a plurality of hydraulic passages 180. Low pressure introduction passages 180 are formed by the plurality of hydraulic passages, and accordingly it is possible to suppress the decrease of the rigidity of pressure plate 6 while ensuring the opening area, relative to a single hydraulic passage.

Moreover, inlet side vane back pressure groove 130*a* in pressure plate 6 is connected with through hole 66, so as to efficiently supply the outlet oil leaked around drive shaft 2, from through hole 66 to inlet side vane back pressure grooves 130*a* and 130*b*.

Moreover, low pressure introduction port 170 is formed on the side of inlet passage IN in the circumferential direction (in the positive direction of the z-axis). Accordingly, the distance between inlet passage IN and low pressure introduction inlet 170 decreases to suppress the resistance of the hydraulic passage.

In the variable displacement vane pump according to the embodiment, the variable displacement vane pump includes a pump body 11; the drive shaft 2 supported by the pump body 11; the rotor 3 which is disposed in the pump body 11, which is driven by the drive shaft 2, which is formed with a plurality of slots 31 in a circumferential direction, and which is provided with a plurality of vanes 32 each slidably received in one of the slots 31; the annular cam ring 4 receiving therein the rotor 3 rotatably, the cam ring 4 being disposed in the pump body 11, and arranged to swing about a swing axis, and to define a plurality of pump chambers with the vanes 32 between the rotor 3 and the cam ring 4; the rear body 12 closing the pump body 11; the pressure plate 6 received in the pump body 11, the pressure plate 6 including the through hole 66 receiving the drive shaft 2, and being arranged to be urged to the rotor 3 by receiving an outlet pressure in the axial direction; inlet ports 62 and 121 formed in the rear body 12 and the pressure plate 6, and opened in the region (inlet region A2*z*+) in which volumes of the pump chambers B are increased; outlet ports 63 and 122 formed in the rear body 12 and the pressure plate 6, and opened in the region (outlet region A2*z*+) in which the volumes of the pump chambers are decreased; first and second fluid pressure chambers A1 and A2 formed radially outside the cam ring 4, and arranged to control an eccentric quantity of the cam ring 4; a pressure control device 7 arranged to control a pressure introduced to one of the first fluid pressure chamber A1 and the second fluid pressure chamber A2; inlet side vane back pressure grooves 130*a* and 130*b* formed at positions corresponding to the inlet region, in the sliding surface (x-axis positive side surface 61 of pressure plate 6) between the rotor 3 and the pressure plate 6 and in the sliding surface (x-axis negative side surface 120 of rear body 12) between the rotor 3 and the rear body 12, and arranged to supply a hydraulic fluid to base end portions of the slots 31 of the rotor 3; outlet side vane back pressure grooves 140*a* and 140*b* formed at positions corresponding to the outlet region, in the sliding surface between the rotor 3 and the pressure plate 6 (x-axis positive side surface 61 of pressure plate 6) and in the sliding surface (x-axis negative side surface 120 of rear body 12) between the rotor 3 and the rear body 12, arranged so that the outlet pressure is introduced, and arranged to supply the outlet pressure to the base end portions of the slots 31 of the rotor 3; the inlet passage IN formed in one of the pressure plate 6 and the rear body 12, and connected with the reservoir tank storing the hydraulic fluid; the low pressure supply passage 160 constantly connecting the inlet passage IN and the other of the first fluid pressure chamber A1 and the second fluid pressure chamber A2; the low pressure introduction port 170 formed in the other of the pressure plate 6 and the rear body 12, and opened in the other of the first fluid pressure chamber A1 and the second fluid pressure chamber A2; and the low pressure introduction passage 180 formed in the other of the pressure plate 6 and the rear body 12, the low pressure introduction passage 180 connecting the low pressure introduction port 170 and the inlet side vane back pressure grooves 130*a*, 130*b*.

Accordingly, the inlet pressure is supplied to back pressure chambers 33 from rear body 12's side and pressure plate 6's side. Therefore, it is possible to readily supply the inlet pressure to back pressure chamber 33, and to ensure the protruding characteristic of the vane 32 from slot 31. Moreover, low pressure introduction inlet 170 is opened in second fluid pressure chamber A2, and it is possible to decrease the resistance of the fluid passage.

In the variable displacement vane pump according to the embodiment, the pressure control device 7 is arranged to control the pressure introduced to the first fluid pressure chamber A1; and the low pressure supply passage 160 constantly connects the inlet passage IN and the second fluid pressure chamber A2.

Accordingly, it is possible to supply the outlet pressure leaked from outlet side By+ through cam ring 4 to second fluid pressure chamber A2, through low pressure introduction port 170 and low pressure introduction passage 180 to vane back pressure grooves 130*a* and 130*b*. Therefore, it is possible to improve the efficiency of the supply of the pressure to vane back pressure grooves 130*a* and 130*b*.

In this variable displacement vane pump according to the embodiment, the low pressure introduction port 170 has an opening area arranged to decrease as the eccentric quantity of the cam ring 4 decreases.

Accordingly, it is possible to increase the opening area of low pressure introduction port 170 in the maximum eccentric state of cam ring 4 that the outlet quantity is great, and to decrease the opening area of low pressure introduction port 170 in the minimum eccentric state of cam ring 4 that the outlet quantity is small. Therefore, it is possible to set the appropriate opening area of low pressure introduction port 170 in accordance with the outlet quantity.

In the variable displacement vane pump according to the embodiment, the variable displacement vane pump further includes sealing members 71-73 disposed between the pressure plate 6 and the pump body 11, the sealing members 50 divide a region between the pressure plate 6 and the pump body 11, to a low pressure region DL and a high pressure region DH; one of the inlet side vane back pressure grooves 130*a* and 130*b* and one of the outlet side vane back pressure grooves 140*a* and 140*b* are formed in a surface of the pressure plate 6 which confronts the rotor 3; and the low pressure introduction port 170 is formed in the low pressure region of the region.

Accordingly, it is possible to urge pressure plate 6 to cam ring 4 in high pressure region DH (that is sealed by second sealing member 72 and third sealing member 73). Moreover, it is possible to introduce the low pressure to low pressure region DL (that is sealed by first seal member 71 and second seal member 72).

In the variable displacement vane pump according to the embodiment, the low pressure region DL is formed in a circumferential position corresponding to the inlet port 62 and 121. Accordingly pressure plate 6 is sandwiched between inlet port 62 and low pressure region DL, and the both sides of pressure plate 6 becomes the low pressure. Therefore, it is possible to improve the pressure balance of pressure plate 6.

In the variable displacement vane pump according to the embodiment, the low pressure introduction passage 180 is formed in the pressure plate 6, and connected with the one of the inlet side vane back pressure grooves 130*a*, and a part of the low pressure introduction passage 180 is formed of a plurality of hydraulic passages (connecting portion 171 and extension portion 172).

Low pressure introduction passage 180 is formed by the plurality of the passages, and accordingly it is possible to suppress the decrease of the rigidity of pressure plate 6 while ensuring the opening area, relative to the single hydraulic passage.

In the variable displacement vane pump according to the embodiment, the one of the inlet side vane back pressure groove 130*a* is directly connected with the through hole 66. Accordingly, it is possible efficiently supply the outlet oil leaked around drive shaft 2, from through hole 66 to inlet side vane back pressure grooves 130*a* and 130*b*.

In the variable displacement vane pump according to the embodiment, the low pressure introduction port 170 is formed at a circumferential position corresponding to the inlet passage IN. Accordingly, it is possible to decrease the distance between inlet passage IN and low pressure introduction port 170, and to suppress the resistance of the hydraulic passage.

Second Embodiment

Figure 6:
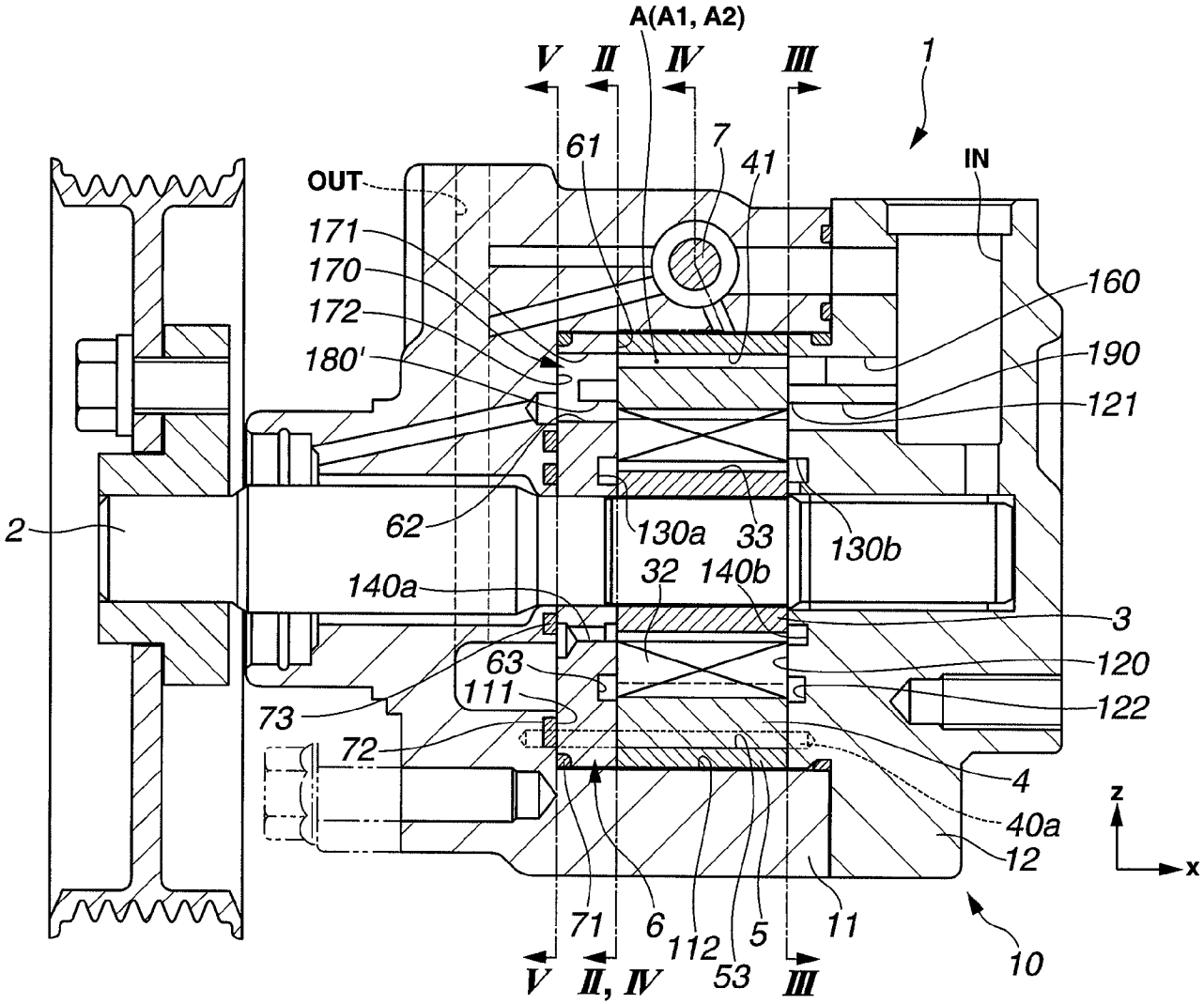
FIG. 6 is an axial sectional view (a sectional view taken along a section line I-I of FIG. 7) showing a vane pump according to a second embodiment of the present invention.
Figure 7:
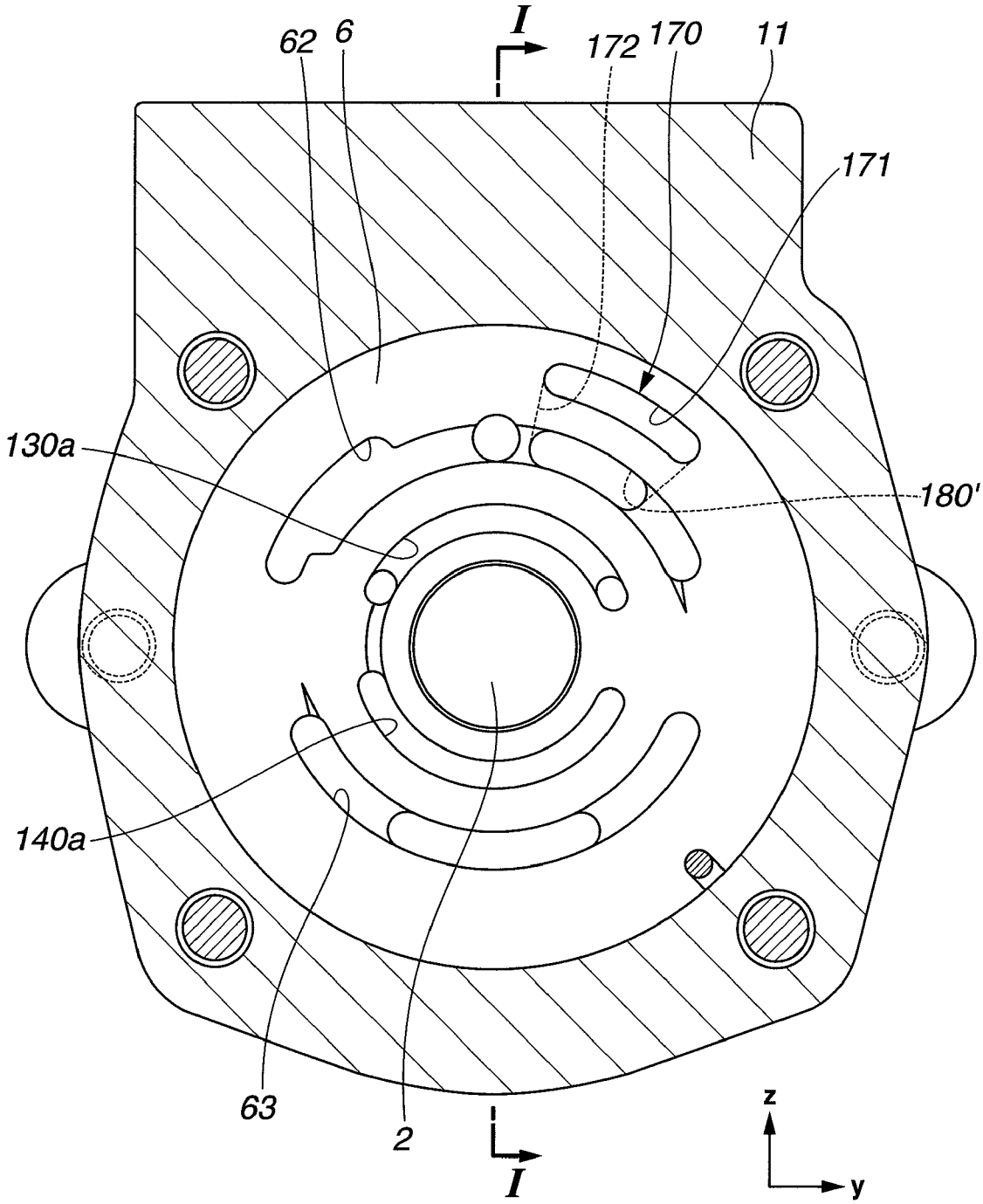
FIG. 7 is a radial sectional view (a sectional view taken along a section line II-II of FIG. 6) showing the vane pump of FIG. 6.
Figure 8:
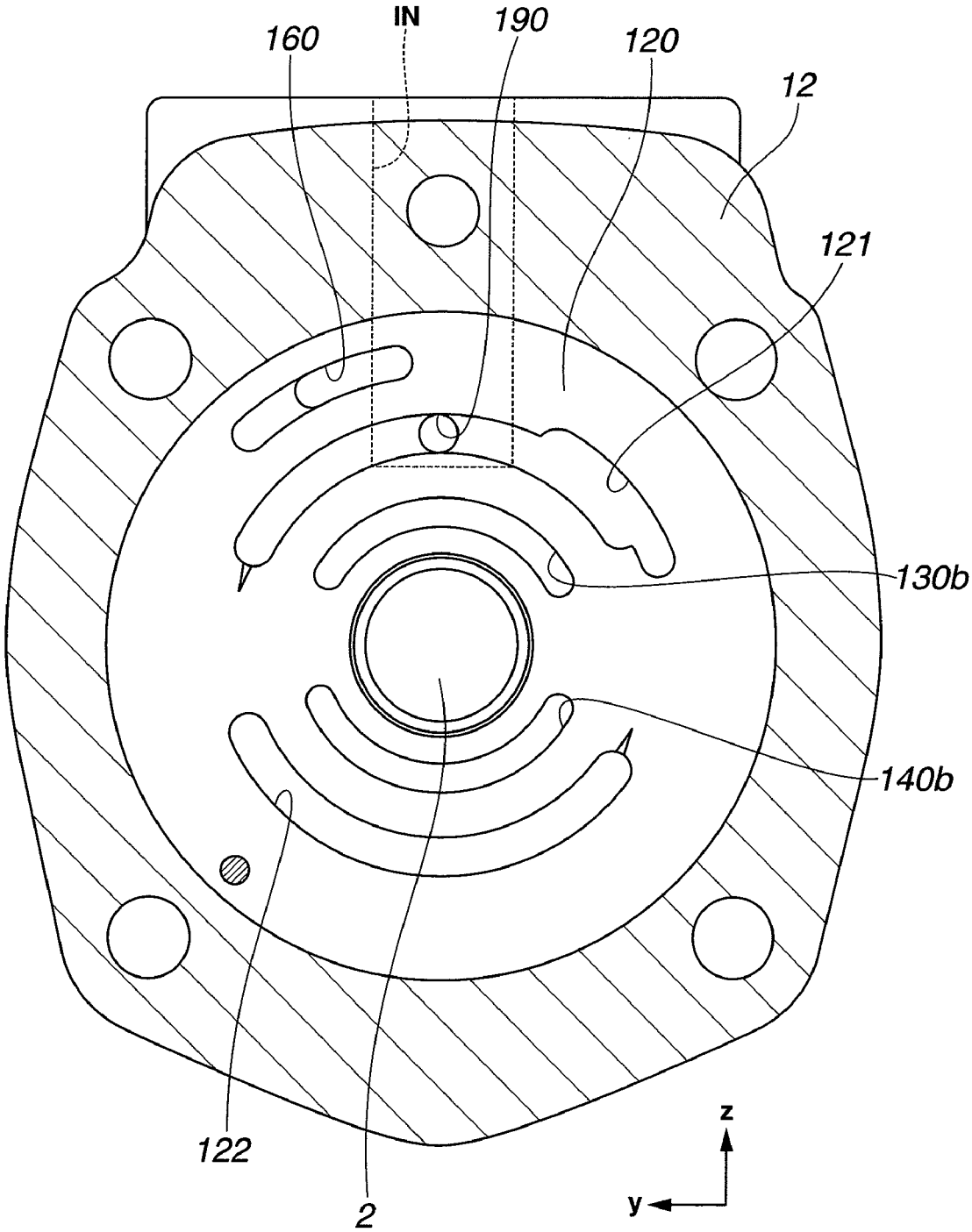
FIG. 8 is a sectional view taken along a section line III-III of FIG. 6.
Figure 9:
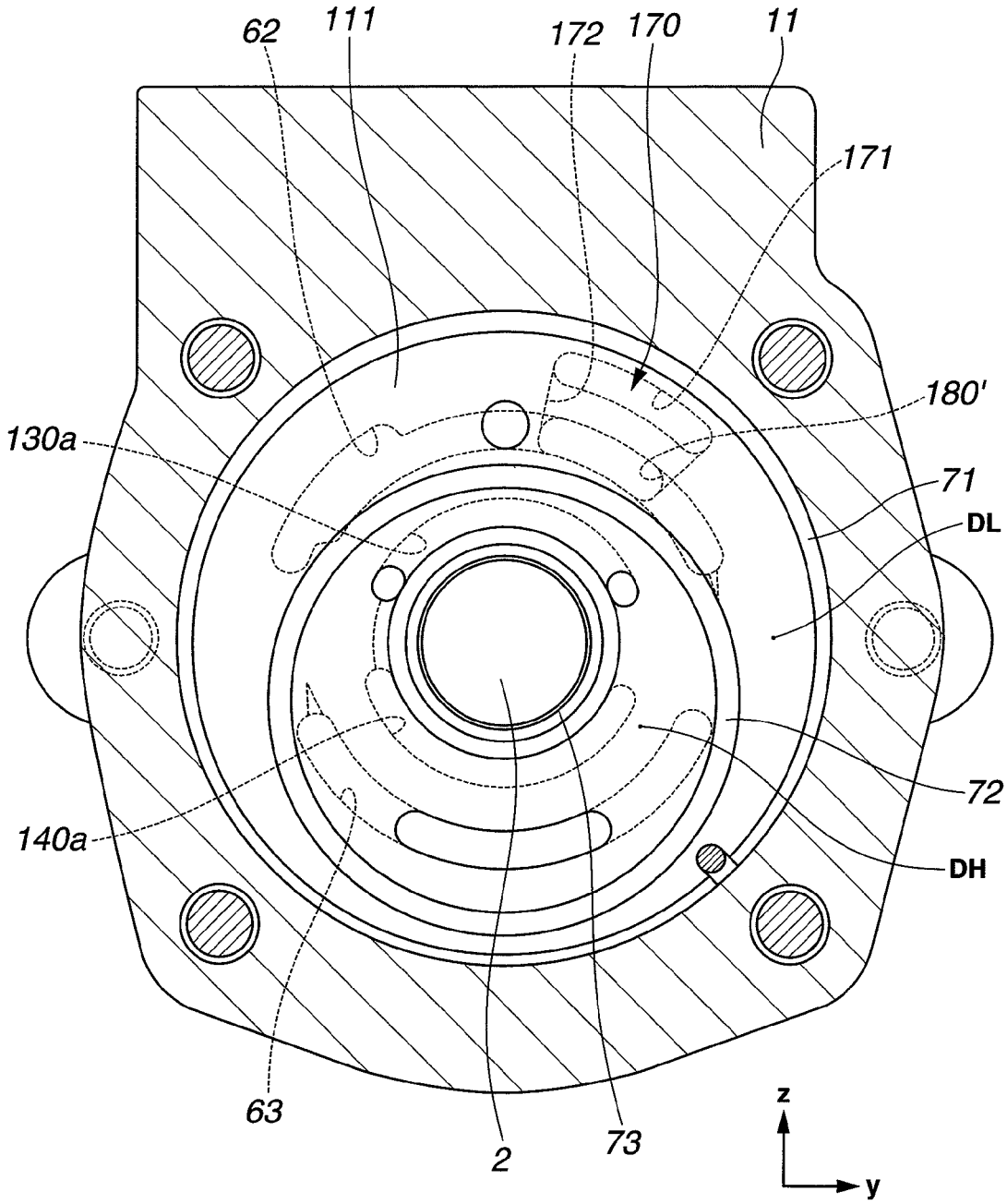
FIG. 9 is a sectional view taken along a section line V-V of FIG. 6.

FIGS. 6-9 show a variable displacement vane pump according to a second embodiment of the present invention. FIG. 6 show an axial sectional view (sectional view taken along a section line I-I of FIG. 7) of the vane pump according to the second embodiment. FIG. 7 is a radial sectional view (a sectional view taken along a section line II-II of FIG. 6). FIG. 7 shows a case in which cam ring 4 is swung, to the maximum extent, to the y-axis negative side (maximum eccentric quantity). FIG. 8 is a sectional view taken along a section line III-III of FIG. 6. FIG. 9 is a sectional view taken along a section line V-V of FIG. 6.

Basic structures of the variable displacement vane pump according to the second embodiment is identical to the structure according to the first embodiment. In the variable displacement vane pump according to the first embodiment, the low pressure is supplied through first low pressure introduction passage 200 and second low pressure introduction passage 180 to inlet side vane back pressure grooves 130*a* and 130*b*. In the variable displacement vane pump according to the second embodiment, first low pressure introduction passage 200 is omitted, and second low pressure introduction passage 180' is connected with inlet port 63 on the pressure plate 6' side.

Accordingly, in the second embodiment, the inlet pressure is introduced to inlet port 121 of rear body 12 (through first low pressure supply passage 190). Moreover, the inlet pressure is introduced from the pressure plate 6's side through low pressure introduction port 170 and second low pressure introduction passage 180' (through first low pressure supply passage 160 and second fluid pressure chamber A2).

In the variable displacement vane pump according to the embodiment, the variable displacement vane pump includes low pressure introduction passage 180' formed in the other of pressure plate 6 and rear body 12, and arranged to connect low pressure introduction port 170 and inlet port 62 (or inlet port 121).

That is, in the second embodiment, the low pressure is not supplied to vane back pressure chambers 130*a* and 130*b*. The inlet pressure is supplied to inlet port 62 and 121 on the both sides of the x-axis direction. Accordingly, it is possible to improve the efficiency of the induction. Moreover, low pressure introduction port 170 is opened to second fluid pressure chamber A2, and accordingly it is possible to decrease the resistance of the fluid passage.

Third Embodiment

Figure 10:
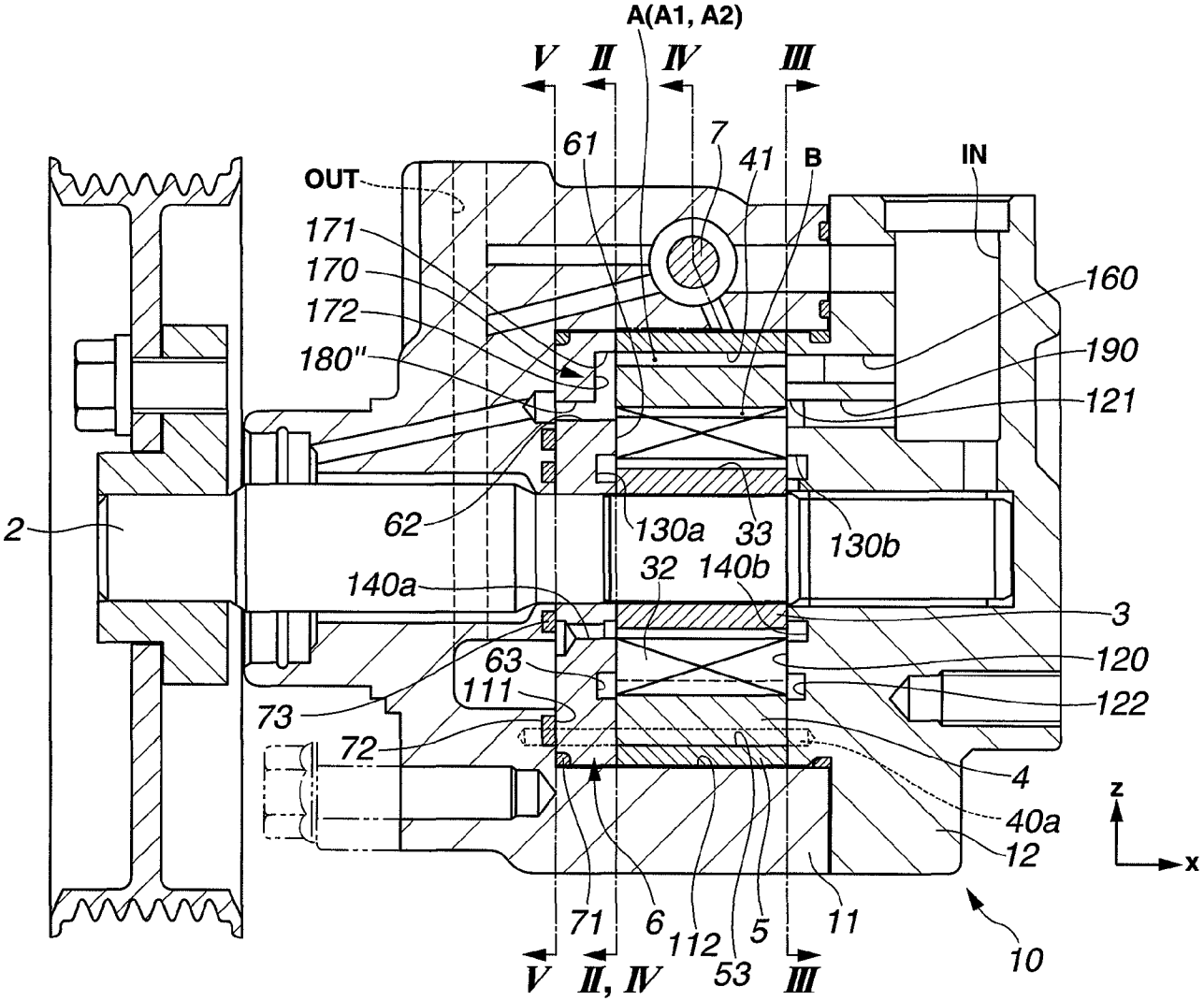
FIG. 10 is an axial sectional view (a sectional view taken along a section line I-I of FIG. 11) showing a vane pump according to a third embodiment of the present invention.
Figure 11:
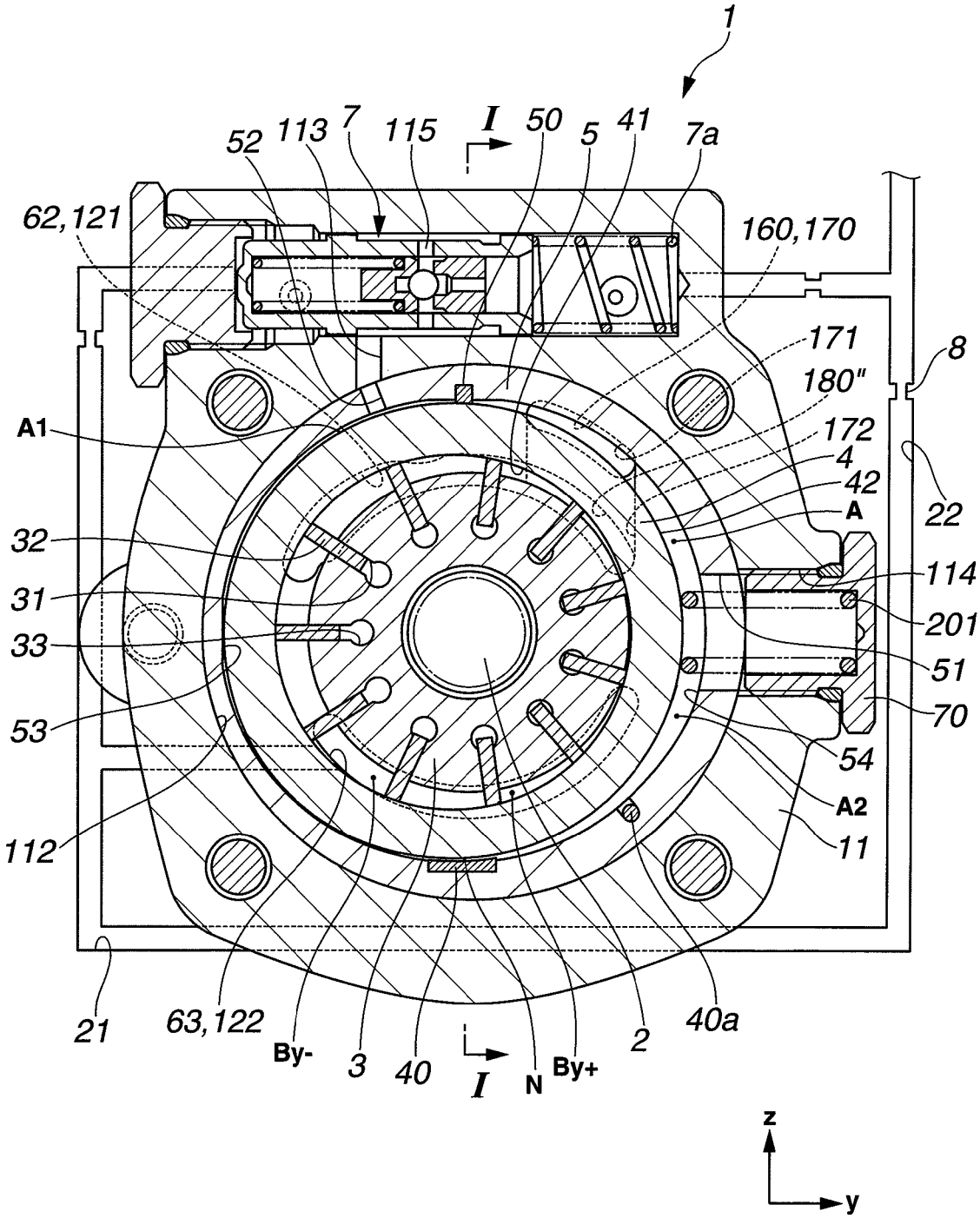
FIG. 11 is a radial sectional view (a sectional view taken along a section line IV-IV of FIG. 10) showing the vane pump of FIG. 10.
Figure 12:
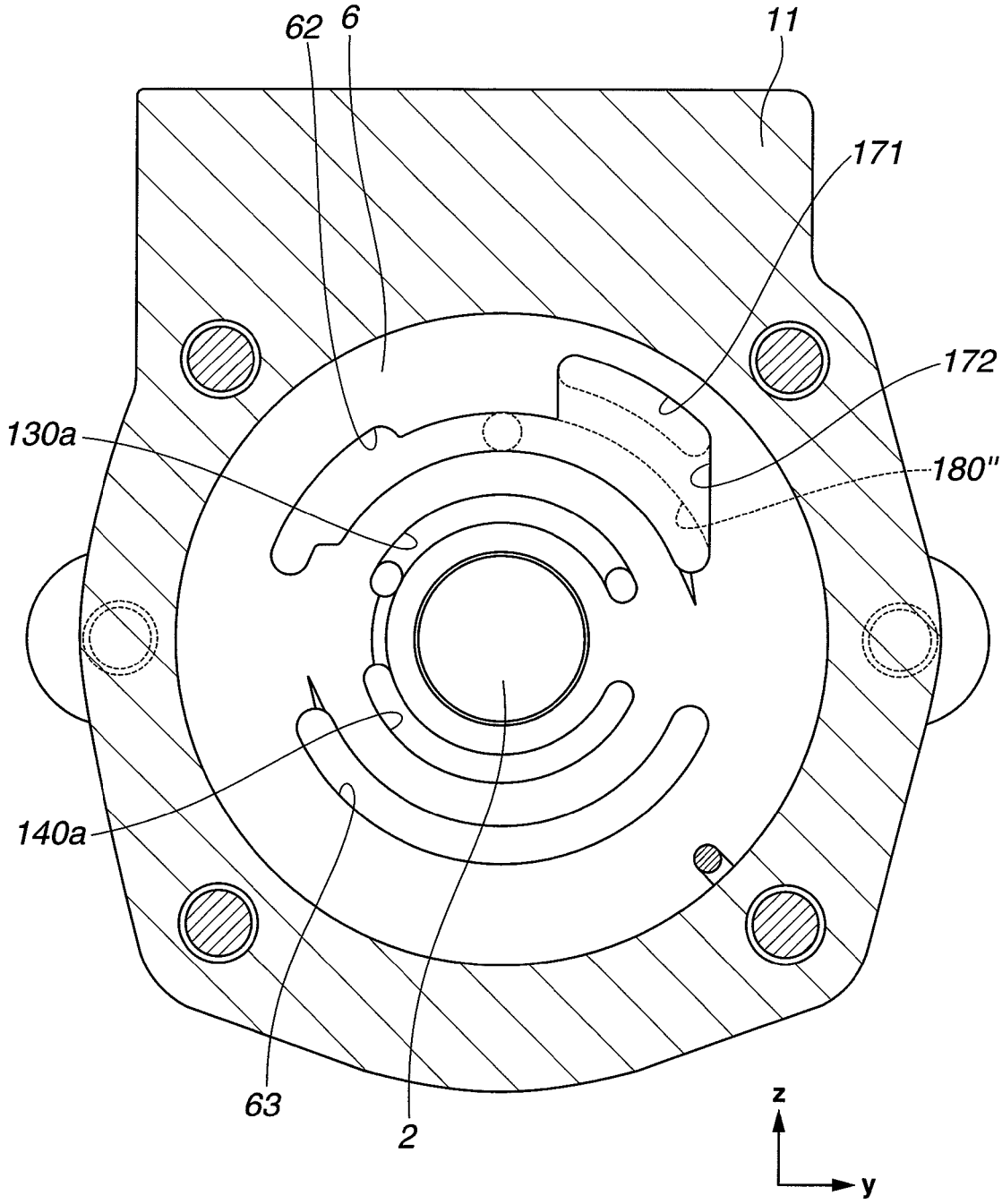
FIG. 12 is a view showing the view of FIG. 11 from which a rotor and vanes are detached.

FIGS. 10-12 show a variable displacement vane pump according to a third embodiment of the present invention. FIG. 10 shows an axial sectional view (sectional view taken along a section line I-I of FIG. 11) of the vane pump according to the third embodiment. FIG. 11 is a radial sectional view (a sectional view taken along a section line IV-IV of FIG. 10). FIG. 11 is shows a case in which cam ring 4 is swung, to the maximum extent, to the y-axis negative direction (maximum eccentric quantity). FIG. 12 is a view showing the variable displacement vane pump from which rotor 3 and vanes 32 are removed.

Basic structure of the variable displacement vane pump according to the third embodiment is identical to the structure according to the second embodiment. First low pressure introduction passage 200 is omitted, similarly to the second embodiment. In the second embodiment, low pressure introduction port 170 is formed in x-axis negative side surface 65 of pressure plate 6. However, in the third embodiment, low pressure introduction port 170 is formed in x-axis positive side surface 61 which confronts cam ring 4 (x-axis direction position and y-axis direction position of low pressure introduction port 170 are overlapped with the positions of cam ring 4).

In the variable displacement vane pump according to the embodiment, the low pressure introduction passage 180 is formed in a surface of the pressure plate 6 which confronts the rotor 3. Accordingly, it is possible to decrease the length of the hydraulic passage through low pressure introduction port 170 to inlet port 62, and to further decrease the resistance of the hydraulic passage.

In the variable displacement vane pump according to the embodiment, the second low pressure introduction passage 180" is connected with a first circumferential end portion (the y-axis positive side, the right side as shown in FIG. 12) of the inlet port 62. Accordingly, it is possible to smoothly flow the hydraulic fluid supplied from the first circumferential end portion (the y-axis positive side, the right side as shown in FIG. 12) of inlet port 62 to the second circumferential end portion (the y-axis negative side, the left side as shown in FIG. 12) of inlet port 62, in accordance with the rotation (the counterclockwise rotation in FIG. 12) of rotor 3. Consequently, it is possible to further improve the induction efficiency.

In the variable displacement vane pump according to the embodiment, the variable displacement vane pump includes the low pressure introduction port 170 formed in the pressure plate 6, and opened in the other of the first fluid pressure chamber A1 and the second fluid pressure chamber A2; and the low pressure introduction passage 180" formed in the pressure plate 6, the low pressure introduction passage 180" connecting the low pressure introduction port 170 with one of the inlet ports 62 and 121 and the vane back pressure grooves 130*a* and 130*b* on the inlet port 62 and 121's side.

Moreover, inlet passage IN is formed in rear body 12, and accordingly it is possible to decrease distance between the inlet pressure and second fluid pressure chamber A2.

In the variable displacement vane pump according to the embodiment, the variable displacement vane pump further includes the adapter ring 5 provided in the receiving portion of the pump body 11, and disposed radially outside the cam ring 4; the first fluid pressure chamber A1 and the second fluid pressure chamber A2 are formed between the adapter ring 5 and the cam ring 4.

Accordingly, adapter ring 5 includes swing point N for cam ring 4, and stopper surface 54 formed on the maximum eccentric side which need the high machining accuracy. Therefore, it is possible to form adapter ring 5 which needs the high machining accuracy, separately from the manufacturing process of pump body 11, and thereby to facilitate the manufacturing process.

In the variable displacement vane pump according to the embodiment, the pressure control device 7 is arranged to switch the outlet pressure and an inlet pressure, and thereby to control one of the pressure of the first fluid pressure chamber A1 and the pressure of the second fluid pressure chamber A2. Accordingly, the control pressure is produced by using the outlet pressure produced by the pump operation, and the inlet pressure which is the reservoir tank pressure, and it is not necessary to provide another pressure producing means.

Fourth Embodiment

Figure 13:
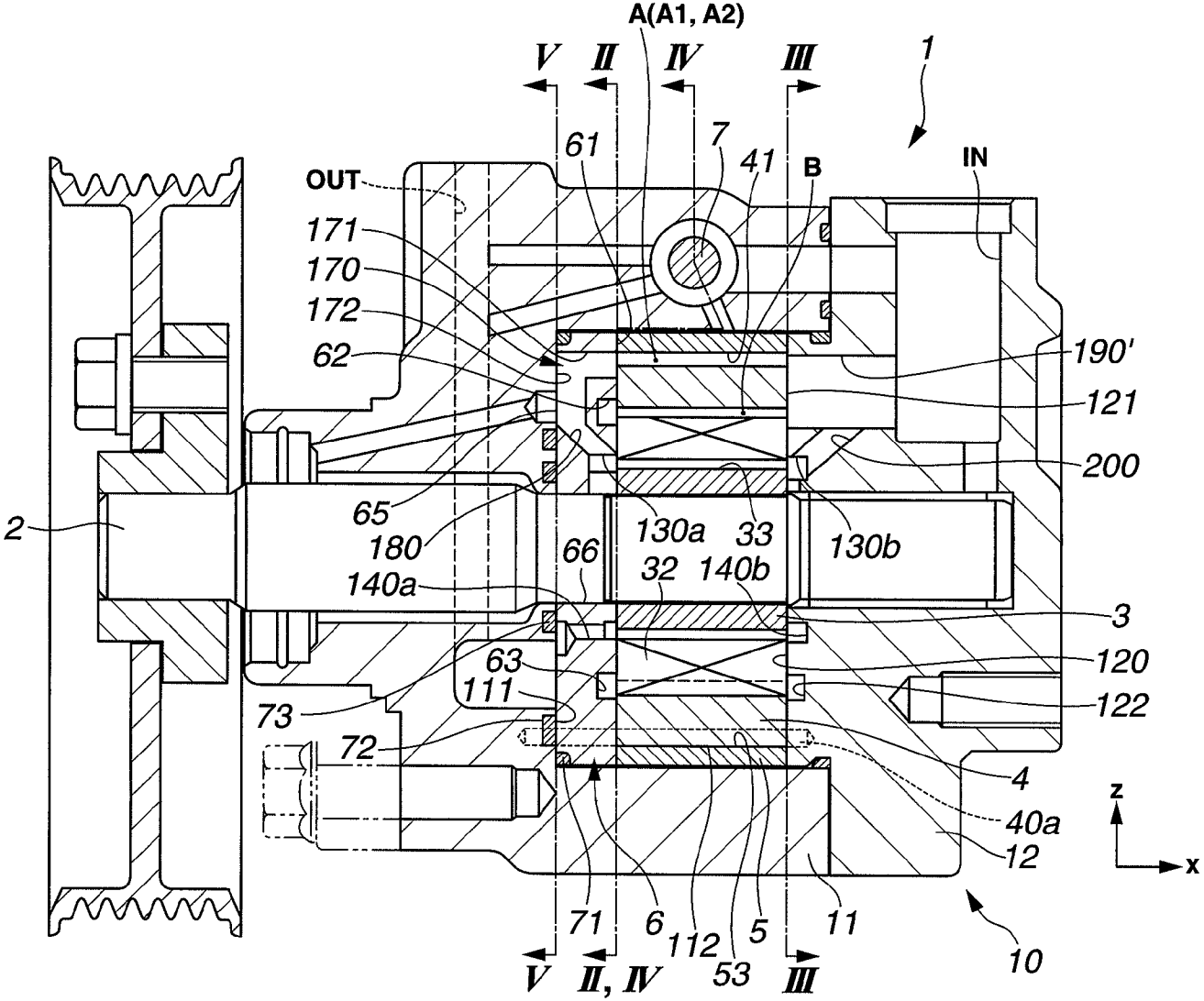
FIG. 13 is an axial sectional view showing a vane pump according to a fourth embodiment of the present invention.
Figure 14:
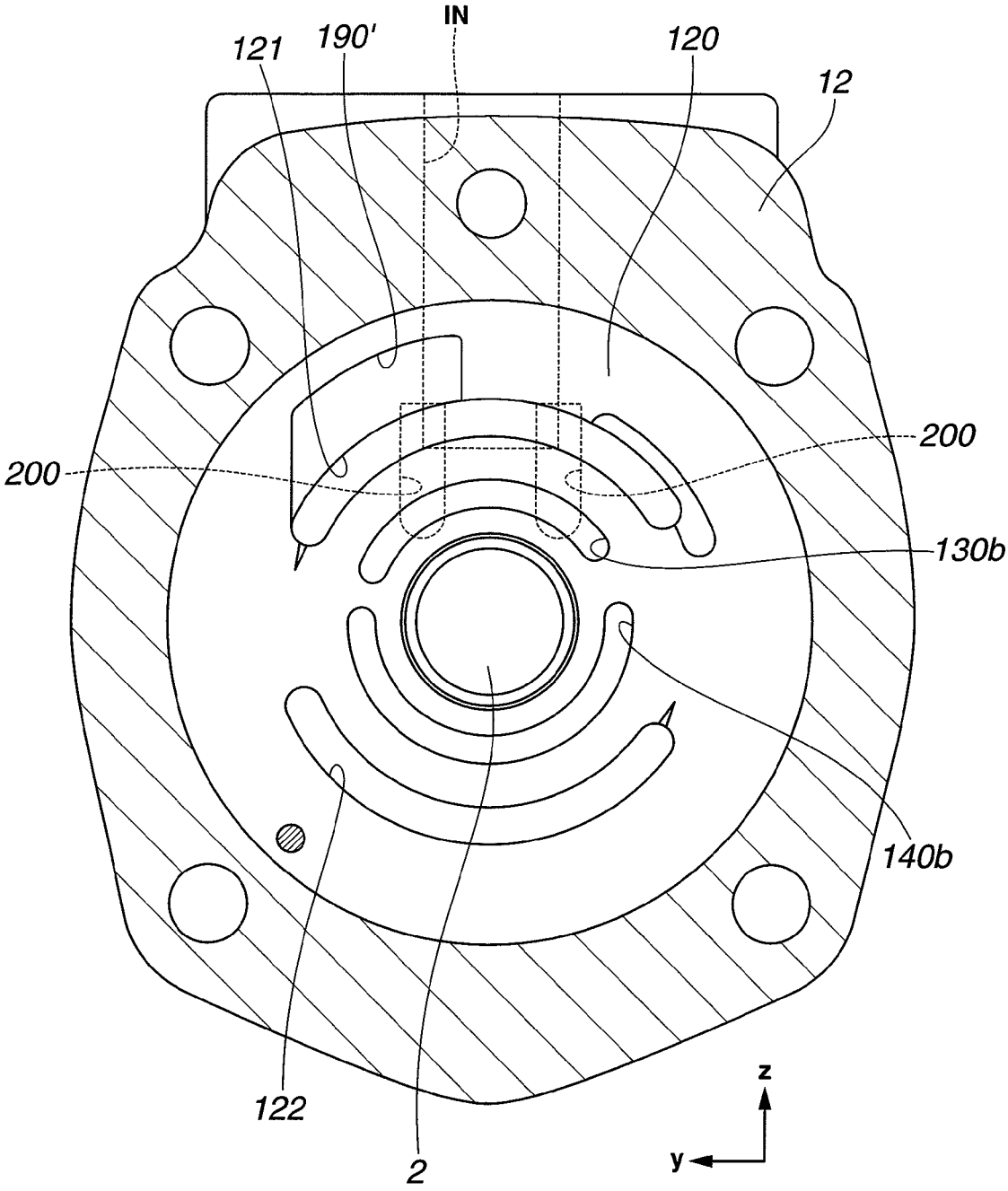
FIG. 14 is a sectional view taken along a section line III-III of FIG. 13.

FIGS. 13 and 14 show a variable displacement vane pump according to a fourth embodiment of the present invention. FIG. 13 shows an axial sectional view showing the vane pump according to the fourth embodiment. FIG. 14 shows a sectional view taken along a section line of III-III of FIG. 13. Basic structure of the variable displacement vane pump according to the fourth embodiment is identical to the structure according to the first embodiment. In the first embodiment, first low pressure supply passage 160 and second low pressure supply passage 190 are different passages. In the fourth embodiment, first low pressure supply passage 160 and second low pressure supply passage 190 are an integral low pressure supply passage 190'. By this low pressure supply passage 190', the inlet pressure is supplied to second fluid pressure chamber A2 and inlet port 121.

In the variable displacement vane pump according to the embodiment, the first low pressure supply passage 190' connecting the inlet passage IN and the inlet port 121, and the second low pressure supply passage 190' constantly connecting inlet port 121 and the other of first fluid pressure chamber A1 and second fluid pressure chamber A2 is integral low pressure supply passage 190'. The variable displacement vane pump includes the low pressure introduction port 170 formed in the other of the pressure plate 6 and the rear body 12, and opened in the other of the first fluid pressure chamber A1 and the second fluid pressure chamber A2.

In the variable displacement vane pump according to the embodiment, the second low pressure supply passage 190' is formed in a surface of the rear body 12 which confronts the cam ring 4. Accordingly, it is possible to readily form the second low pressure supply passage 190'.

In the variable displacement vane pump according to the embodiment, the pressure control device 7 is arranged to control the pressure introduced to the first fluid pressure chamber A1; and the second low pressure supply passage 190' constantly connects the inlet passage IN and the second fluid pressure chamber A2.

Accordingly, it is possible to supply the outlet pressure leaked from outlet side By+ through cam ring 4 to is second fluid pressure chamber A2, through low pressure introduction port 170 and low pressure introduction passage 180 to vane back pressure grooves 130*a* and 130*b*, and to improve the pressure supply efficiency to vane back pressure grooves 130*a* and 130*b*.

Figure 15:
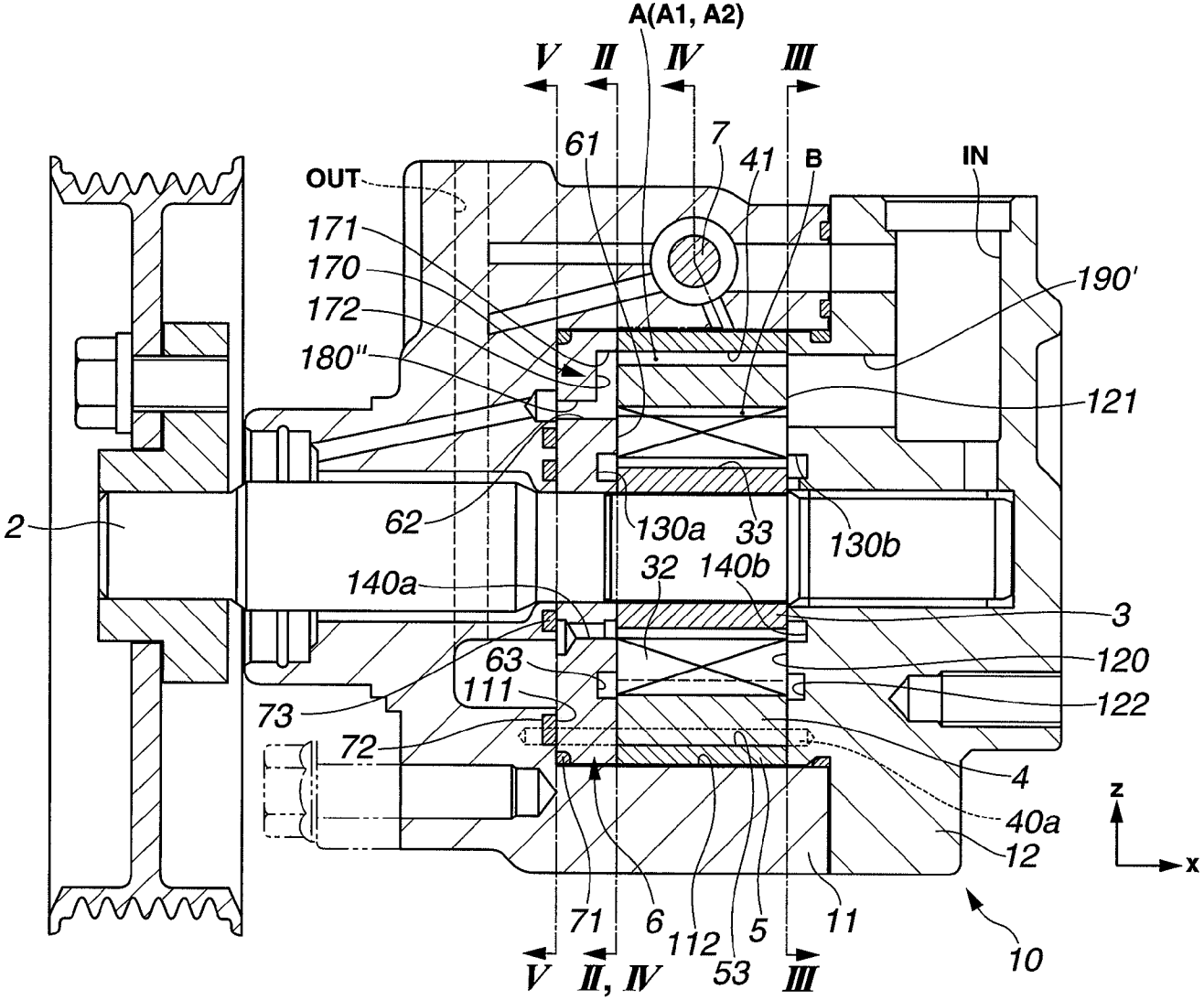
FIG. 15 is an axial sectional view showing a vane pump according to a fifth embodiment of the present invention.
Figure 16:
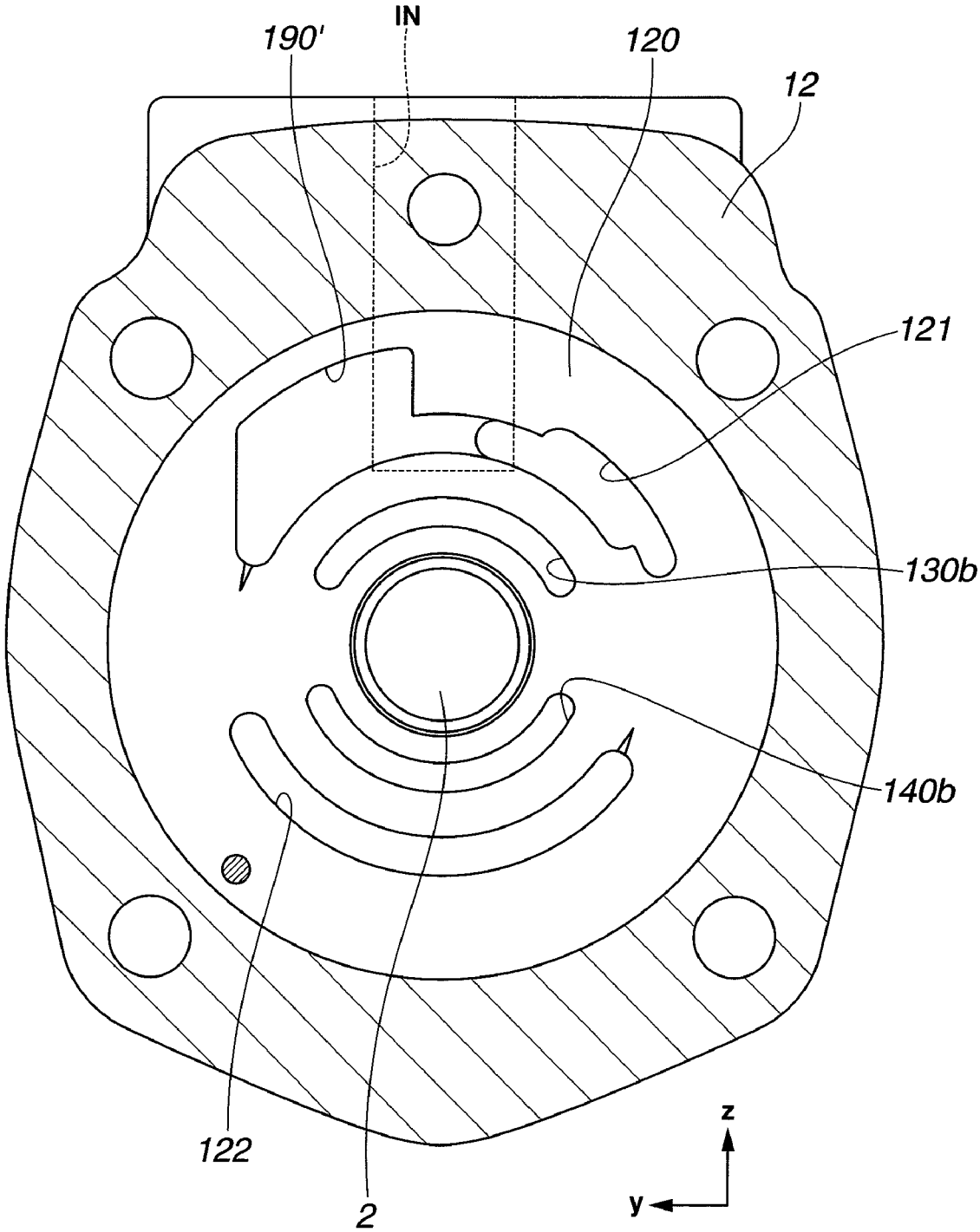
FIG. 16 is a sectional view taken along a section line III-III of FIG. 15.

FIGS. 15 and 16 show a variable displacement vane pump according to a fifth embodiment of the present invention. FIG. 15 shows an axial sectional view showing the variable displacement pump according to the fifth embodiment of the present invention. FIG. 16 shows a sectional view taken along a section line III-III of FIG. 15. Basic structure of the variable displacement vane pump according to the fifth embodiment is identical to the structure according to the fourth embodiment. In fifth embodiment, first and second low pressure introduction passages 180 and 200 arranged to connect low pressure introduction port 170 and inlet port 121 or vane back pressure groove 130*a* on inlet port 121's side are omitted.

In the variable displacement vane pump according to the embodiment, the pressure control device 7 is arranged to control the pressure introduced to the first fluid pressure chamber A1; and the second low pressure supply passage 160 constantly connects the inlet passage IN and the second fluid pressure chamber A2.

Accordingly, it is possible to supply the outlet pressure leaked from outlet side By+ through cam ring 4 to second fluid pressure chamber A2, through low pressure introduction port 170 and low pressure introduction passage 180" to inlet ports 62 and 121, and to improve the pressure supply efficiency to inlet ports 62 and 121.

Figure 17:
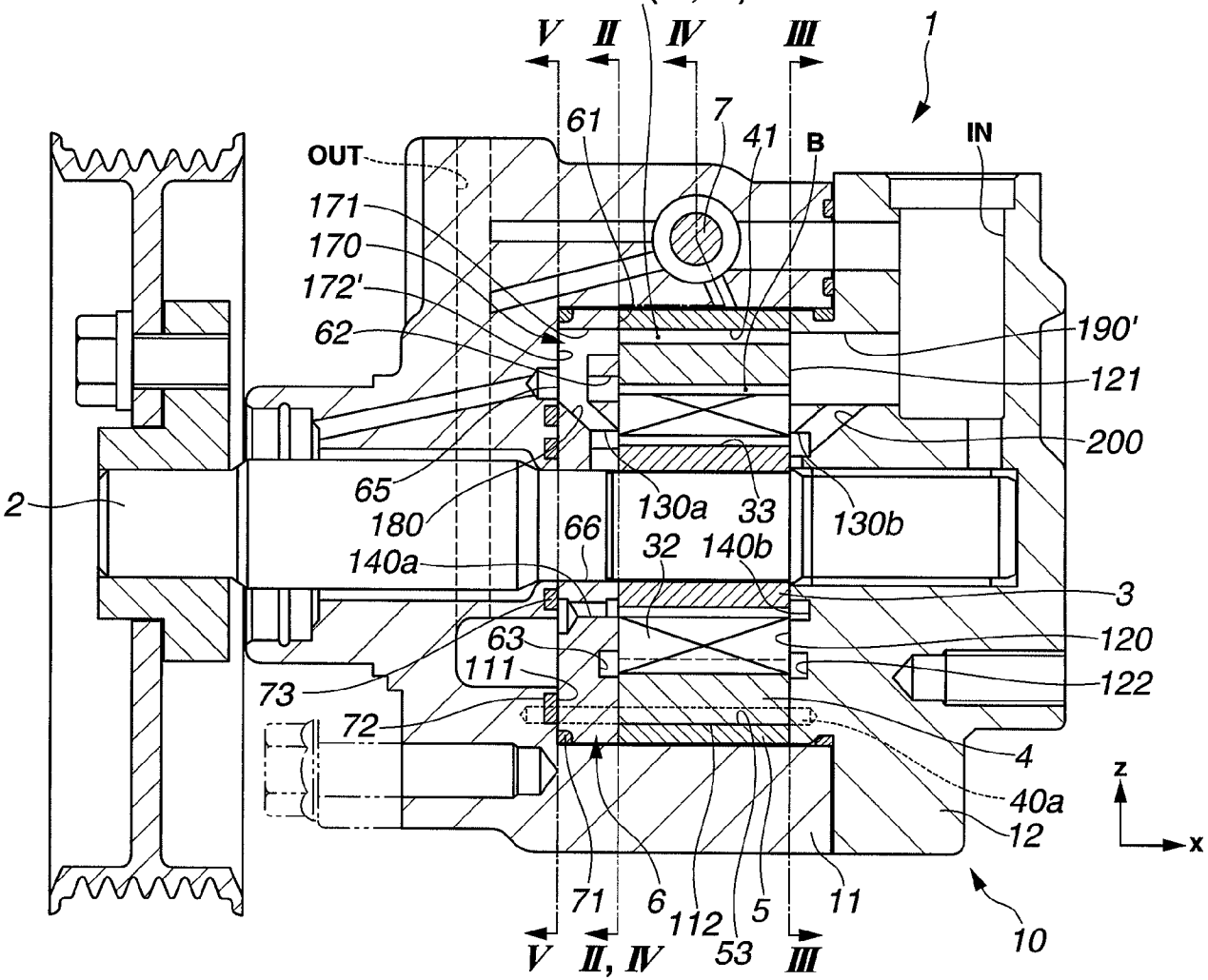
FIG. 17 is an axial sectional view showing a vane pump according to a sixth embodiment of the present invention.
Figure 18:
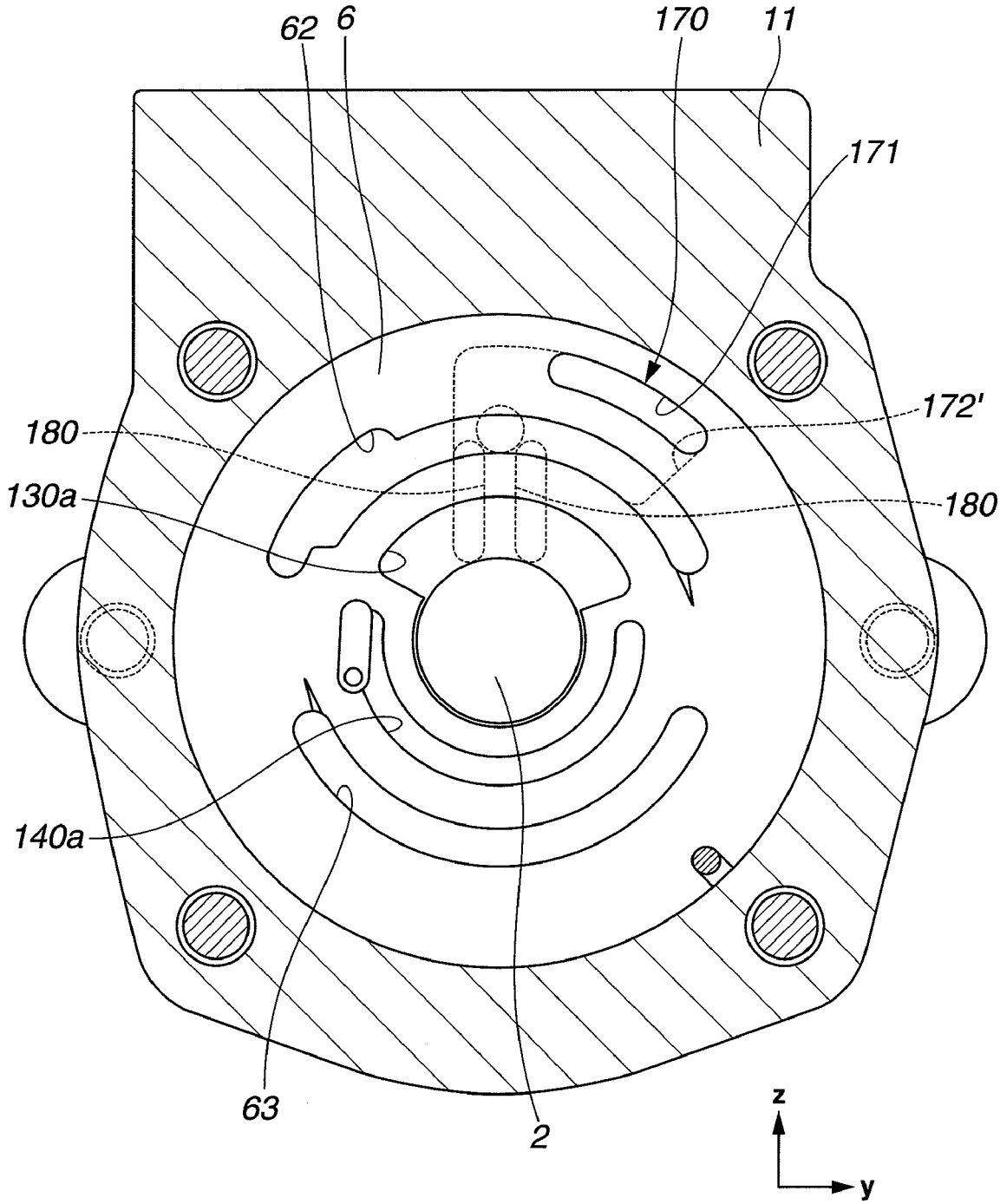
FIG. 18 is a sectional view taken along a section line III-III of FIG. 17.

FIGS. 17 and 18 show a variable displacement vane pump according to a sixth embodiment of the present invention. FIG. 17 shows an axial sectional view showing the variable displacement pump according to the sixth embodiment of the present invention. FIG. 18 shows a sectional view taken along a section line III-III of FIG. 17. Basic structure of the variable displacement vane pump according to the sixth embodiment is identical to the structure according to the first embodiment. In the sixth embodiment, there is provided an extension portion 172' enlarged in the positive direction of the y-axis by extending low pressure introduction port 170 in the positive direction of the y-axis. Moreover, in the sixth embodiment, inlet port 62 of pressure plate 6 is connected to extension portion 172', like the second embodiment.

Extension portion 172' extends further in the y-axis positive direction. Accordingly, it is possible to further increase the opening area of low pressure introduction port 170 when cam ring 4 is in the maximum eccentric state (the eccentric in the y-axis positive direction) of cam ring 4 that the outlet quantity is great.

This application is based on a prior Japanese Patent Application No. 2007-053722. The entire contents of the Japanese Patent Application No. 2007-053722 with a filing date of Mar. 5, 2007 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A variable displacement vane pump comprising:

a pump body;

a drive shaft supported by the pump body;

a rotor which is disposed in the pump body, which is driven by the drive shaft, which is formed with a plurality of slots in a circumferential direction, and which is provided with a plurality of vanes each slidably received in one of the slots;

an annular cam ring receiving therein the rotor rotatably, the cam ring being disposed in the pump body, and arranged to swing about a swing axis, and to define a plurality of pump chambers with the vanes between the rotor and the cam ring;

a rear body closing the pump body;

a pressure plate received in the pump body, the pressure plate including a through hole receiving the drive shaft, and being arranged to be urged to the rotor by receiving an outlet pressure in an axial direction;

inlet ports formed in the rear body and the pressure plate, and opened in a region in which volumes of the pump chambers are increased;

outlet ports formed in the rear body and the pressure plate, and opened in a region in which the volumes of the pump chambers are decreased;

first and second fluid pressure chambers formed radially outside the cam ring, and arranged to control an eccentric quantity of the cam ring;

a pressure control device arranged to control a pressure introduced to one of the first fluid pressure chamber and the second fluid pressure chamber;

inlet side vane back pressure grooves formed at positions corresponding to an inlet region, in a sliding surface between the rotor and the pressure plate and in a sliding surface between the rotor and the rear body, and arranged to supply a hydraulic fluid to base end portions of the slots of the rotor;

outlet side vane back pressure grooves formed at positions corresponding to an outlet region, in the sliding surface between the rotor and the pressure plate and in the sliding surface between the rotor and the rear body, arranged so that the outlet pressure is introduced, and arranged to supply the outlet pressure to the base end portions of the slots of the rotor;

an inlet passage formed in one of the pressure plate and the rear body, and connected with a reservoir tank storing the hydraulic fluid;

a low pressure supply passage constantly connecting the inlet passage and the other of the first fluid pressure chamber and the second fluid pressure chamber;

a low pressure introduction port formed in the other of the pressure plate and the rear body, and opened in the other of the first fluid pressure chamber and the second fluid pressure chamber; and a low pressure introduction passage formed in the other of the pressure plate and the rear body, the low pressure introduction passage connecting the low pressure introduction port and the inlet side vane back pressure grooves.

2. The variable displacement vane pump as claimed in claim 1, wherein the pressure control device is arranged to control the pressure introduced to the first fluid pressure chamber; and the low pressure supply passage constantly connects the inlet passage and the second fluid pressure chamber.

3. The variable displacement vane pump as claimed in claim 2, wherein the low pressure introduction port has an opening area arranged to decrease as the eccentric quantity of the cam ring decreases.

4. The variable displacement vane pump as claimed in claim 1, wherein the variable displacement vane pump further comprises sealing members disposed between the pressure plate and the pump body, the sealing members divide a region between the pressure plate and the pump body, to a low pressure region and a high pressure region; one of the inlet side vane back pressure grooves and one of the outlet side vane back pressure grooves are formed in a surface of the pressure plate which confronts the rotor; and the low pressure introduction passage is formed in the low pressure region of the region.

5. The variable displacement vane pump as claimed in claim 4, wherein the low pressure region is formed in a circumferential position corresponding to the inlet port.

6. The variable displacement vane pump as claimed in claim 4, wherein the low pressure introduction passage is formed in the pressure plate, and connected with the one of the inlet side vane back pressure grooves, and a part of the low pressure introduction passage is formed of a plurality of hydraulic passages.

7. The variable displacement vane pump as claimed in claim 4, wherein the one of the inlet side vane back pressure groove is directly connected with the through hole.

8. The variable displacement vane pump as claimed in claim 1, wherein the low pressure introduction port is formed at a circumferential position corresponding to the inlet passage.

9. A variable displacement vane pump comprising:

a pump body including a receiving portion opened in one axial direction;

a drive shaft supported by the pump body;

a rotor which is disposed in the receiving portion of the pump body, which is driven by the drive shaft, which is formed with a plurality of slots in a circumferential direction, and which is provided with a plurality of vanes each slidably received in one of the slots;

an annular cam ring receiving therein the rotor rotatably, the cam ring being disposed in the pump body, and arranged to swing about a swing axis, and to define a plurality of pump chambers with the vanes between the rotor and the cam ring;

a rear body closing the receiving portion of the pump body;

a pressure plate received in the pump body, and arranged to be urged to the rotor by receiving an outlet pressure in the one axial direction;

inlet ports formed in the rear body and the pressure plate, and opened in a region in which volumes of the pump chambers are increased;

outlet ports formed in the rear body and the pressure plate, and opened in a region in which the volumes of the pump chambers are decreased;

first and second fluid pressure chambers formed radially outside the cam ring, and arranged to control an eccentric quantity of the cam ring;

a pressure control device arranged to control a pressure introduced to one of the first fluid pressure chamber and the second fluid pressure chamber;

vane back pressure grooves formed in a sliding surface between the rotor and the pressure plate and in a sliding surface between the rotor and the rear body, and arranged to supply a hydraulic fluid to base end portions of the slots of the rotor;

an inlet passage formed in the rear body, and connected with a reservoir tank storing the hydraulic fluid;

a low pressure supply passage constantly connecting the inlet passage and the other of the first fluid pressure chamber and the second fluid pressure chamber;

a low pressure introduction port formed in the pressure plate, and opened in the other of the first fluid pressure chamber and the second fluid pressure chamber; and a low pressure introduction passage formed in the pressure plate, the low pressure introduction passage connecting the low pressure introduction port with one of the inlet ports and the vane back pressure grooves on the inlet port's side.

10. The variable displacement vane pump as claimed in claim 9, wherein the variable displacement vane pump further comprises an adapter ring provided in the receiving portion of the pump body, and disposed radially outside the cam ring; the first fluid pressure chamber and the second fluid pressure chamber are formed between the adapter ring and the cam ring.

11. The variable displacement vane pump as claimed in claim 9, wherein the pressure control device is arranged to switch the outlet pressure and an inlet pressure, and thereby to control one of the pressure of the first fluid pressure chamber and the pressure of the second fluid pressure chamber.

12. A variable displacement vane pump comprising:

a pump body including a receiving portion opened in one axial direction;

a drive shaft supported by the pump body;

a rotor which is disposed in the receiving portion of the pump body, which is driven by the drive shaft, which is formed with a plurality of slots in a circumferential direction by the drive shaft, which is formed with a plurality of slots in a circumferential direction, and which is provided with a plurality of vanes each slidably received in one of the slots;

an annular cam ring receiving therein the rotor rotatably, the cam ring being disposed in the pump body, and arranged to swing about a swing axis, and to define a plurality of pump chambers with the vanes between the rotor and the cam ring;

a rear body closing the receiving portion of the pump body;

a pressure plate received in the pump body, and arranged to be urged to the rotor by receiving an outlet pressure in the one axial direction;

inlet ports formed in the rear body and the pressure plate, and opened in a region in which volumes of the pump chambers are increased;

outlet ports formed in the rear body and the pressure plate, and opened in a region in which the volumes of the pump chambers are decreased;

first and second fluid pressure chambers formed radially outside the cam ring, and arranged to control an eccentric quantity of the cam ring;

a pressure control device arranged to control a pressure introduced to one of the first fluid pressure chamber and the second fluid pressure chamber;

vane back pressure grooves formed in a sliding surface between the rotor and the pressure plate and in a sliding surface between the rotor and the rear body, and arranged to supply a hydraulic fluid to base end portions of the slots of the rotor;

an inlet passage formed in one of the pressure plate and the rear body, and connected with a reservoir tank storing the hydraulic fluid;

a first low pressure supply passage connecting the inlet passage and the inlet ports;

a second low pressure supply passage constantly connecting the inlet ports and the other of the first fluid pressure chamber and the second fluid pressure chamber;

a low pressure introduction port formed in the other of the pressure plate and the rear body, and opened in the other of the first fluid pressure chamber and the second fluid pressure chamber; and a low pressure introduction passage formed in the other of the pressure plate and the rear body, the low pressure introduction passage connecting the low pressure introduction port with the vane back pressure grooves on the inlet port's side.

13. The variable displacement vane pump as claimed in claim 12, wherein the second low pressure supply passage is formed in a surface of the rear body which confronts the cam ring.

14. The variable displacement vane pump as claimed in claim 12, wherein the pressure control device is arranged to control the pressure introduced to the first fluid pressure chamber; and the second low pressure supply passage constantly connects the inlet passage and the second fluid pressure chamber.

* * * * *